US005398102A

United States Patent [19]

Wada et al.

[11] Patent Number: 5,398,102

[45] Date of Patent: Mar. 14, 1995

[54] ELECTROPHOTOGRAPHIC COPIER AND CHARGING MEANS USED THEREFOR

[75] Inventors: Takasumi Wada, Nara; Kenji Tani, Yamatokoriyama; Takashi Hayakawa, Soraku; Kouichi Irihara, Nara; Yukihito Nishio, Gojo, all of Japan

[73] Assignee: Sharp Kabushiki Kaisha, Osaka, Japan

[21] Appl. No.: 50,570

[22] Filed: Apr. 21, 1993

[30] Foreign Application Priority Data

| | | | |
|---|---|---|---|
| Apr. 21, 1992 | [JP] | Japan | 4-126636 |
| Apr. 30, 1992 | [JP] | Japan | 4-135630 |
| May 27, 1992 | [JP] | Japan | 4-158850 |
| May 28, 1992 | [JP] | Japan | 4-159989 |
| Jun. 4, 1992 | [JP] | Japan | 4-168351 |
| Jun. 10, 1992 | [JP] | Japan | 4-175006 |

[51] Int. Cl.[6] ..... G03G 15/02

[52] U.S. Cl. ..... 355/219; 361/225

[58] Field of Search ..... 355/200, 210, 219, 222, 355/227; 361/225

[56] References Cited

U.S. PATENT DOCUMENTS

| | | | |
|---|---|---|---|
| 4,336,565 | 6/1982 | Murray et al. | 361/225 |
| 4,371,252 | 2/1983 | Uchida et al. | 361/225 X |
| 4,455,078 | 6/1984 | Mukai et al. | 355/219 |
| 4,457,615 | 7/1984 | Seanor | 355/219 |
| 4,547,060 | 10/1985 | Lindbald | 355/219 |
| 4,706,320 | 11/1987 | Swift | 355/219 X |
| 4,761,709 | 8/1988 | Ewing et al. | 361/225 |
| 5,012,282 | 4/1991 | Wanou et al. | 355/219 |
| 5,146,280 | 9/1992 | Kisu | 355/219 |
| 5,221,946 | 6/1993 | Kohyama | 355/270 |
| 5,245,386 | 9/1993 | Asano et al. | 355/219 |

FOREIGN PATENT DOCUMENTS

| | | |
|---|---|---|
| 55-29837 | 3/1980 | Japan . |
| 59-204859 | 11/1984 | Japan . |
| 60-205550 | 10/1985 | Japan . |
| 60-205551 | 10/1985 | Japan . |
| 60-216361 | 10/1985 | Japan . |
| 64-73367 | 3/1989 | Japan . |
| 2-62563 | 3/1990 | Japan . |

OTHER PUBLICATIONS

Patent Abstracts of Japan, vol. 10, No. 64 (p. 436), Mar. 14, 1986.

Patent Abstracts of Japan, vol. 9, No. 72 (p. 345), Apr. 2, 1985.

*Primary Examiner*—A. T. Grimley

*Assistant Examiner*—Sandra L. Brasé

*Attorney, Agent, or Firm*—Birch, Stewart, Kolasch & Birch

[57] ABSTRACT

The invention is directed to an apparatus for an electrophotographic process, equipped with a charging device of a contact type using a conductive roller or brush, and the charging device used therefor. The apparatus is characterized in the following constructions: roll-shaped fiber aggregation that is rotated in contact with the photoconductive surface through a spacing member; use as applied voltage to the fiber aggregation of periodically oscillating voltage having a lower limit exceeding the surface potential of the photoconductor in the aforementioned device; a brush-type charger that is vibrated while contacted with the photoconductor surface and regulated as required; a fiber roll-type charger wherein ventilation holes are disposed on the roller substrate surface; the fiber roll-type charger with holes further including a closed container with exhausting means enclosing the charger; set-up of a product of planting fiber intervals on a fiber roller and a peripheral velocity ratio of the photoconductor to the roller such that the product is smaller the average particle size of the developer used; changing application voltage to a charger roller depending transfer-treated portion or portions otherwise on the photoconductor surface; and provision of dirt preventer, aligned with the longitudinal direction to the charging roller with conductive fiber, and shiftable between contact and spaced position.

9 Claims, 15 Drawing Sheets

ELECTROPHOTOGRAPHIC COPIER AND CHARGING MEANS USED THEREFOR

BACKGROUND OF THE INVENTION

1. Filed of the Invention

The present invention relates to an electrophotographic process and more particularly to an improvement of an electrophotographic copier and charging means used therefor.

2. Description of the Related Art

As is well known, there have been many proposals for duplicating machines and particularly, in recent years, most of these are proposed electrophotographic copiers. Such an electrophotographic copier is typically, elementally constructed of a photoconductor drum, a charging unit, an exposure unit, a developing unit, an image transfer unit, an erasing unit and a cleaner, and all the elements are disposed around the photoconductor drum to effect a series of electrophotographic process. In addition, there are arranged elementally a paper feed tray, paper guides, paper feed rollers, the image transfer charging unit, a suction unit (for conveying), a fixing unit and paper discharge rollers. With such configurations, an image transferred on a sheet is fixed to create a duplication. More specifically, as shown in FIG. 1 of a schematic view, an image forming apparatus based on electrophotography comprises a photoconductor drum 1, in which a photoconductive film is formed on a conductive support, and a series of the following elements disposed upstream to downstream of a rotational direction of the photoconductor drum 1, that is, a charging unit 102, an exposure unit 103 for illuminating light on the photoconductor drum 1 impressed at a charging potential by charging unit 102 to discharge the static charges on the photoconductor drum 1 and create a desired electrostatic latent image, a developing unit 104 for supplying toner powder to the photoconductor drum 1 having the electrostatic latent image, an image transfer unit 106 for transferring the toner powder image on the photoconductor drum 1 onto a recording sheet 105, a fixing unit 107 for melt-fixing the tonered image transferred on the recording sheet 105 by heating and/or pressing, an erasing unit 108 for erasing the static charges remaining on the photoconductor drum 1 after light-irradiation on the photoconductor drum 1 and image transfer, and a cleaner 109 for removing the residual toner on the photoconductor drum 1.

Of these, as the charging unit for charging the photoconductor at a desired potential a corona charger utilizing a corona discharge phenomenon has been used in the prior art. This means requires a high voltage, so that there has been a fear that the voltage may influence a microcomputer, etc. To make the matter worse, upon the corona-discharging, a large quantity of ozone gas will be generated which not only deteriorates resin material used for the cleaning blade, etc, but also gives unpleasant feelings, causing environmental problems. To eliminate such problems, charging means which charges a photoconductor by an electro-conductive roller or fiber aggregation applied with a voltage has been proposed, for example, in Japanese Patent Application Laid-Open sho-55 No.29837.

FIG. 2 shows an oblique view of an example of such a prior art charging means. In the figure, reference numeral 1 designates a photoconductor drum, of which surface 1*a* is in contact with conductive fiber 5*a* planted brush-wise on a fiber substrate 5*d* made of aluminum or other conductive material.

In this case, since the mechanism is constructed such that the conductive fiber 5*a* fixed is brought into contact with the photoconductor surface 1*a*, the structure might be simple, but the developer and other foreign substances easily to build up between fibers or tips of fibers, causing abnormal discharge resulting in a reduction of the fiber life, and/or causing changing unevenness.

On the other hand, in order to improve the situation, there is disclosed a charging device which, obliquely shown in FIG. 3, comprises, for example, a shaft 5*c* and conductive fiber 5*a* (as stated above) planted therearound to form a roll-shaped member. This roll-shaped member is rotated relative to the photoconductor drum 1 by a driver (not shown). As a result, the reduction of the fiber life and changing unevenness which are caused by the adhesion of foreign substances or other reason can be remedied and bettered remarkably.

Another example of prior art is shown perspectively in FIG. 4, in which there are provided a photoconductor drum 1, a photoconductive medium 1*a* made of a photoconductive dielectric layer, a charging member 5 comprising a roller shaft 5*c* covered with conductive rubber therearound. As shown in the figure, the charging mechanism of this kind has typically utilized elastic rollers as its changing means. In other words, a substance used for the member had to have a highly smooth surface and to be less changed or degraded with the passage of time, in order to afford uniform discharge. In addition, the means was required to be constructed such that, the charge supplying member should be prevented from damaging and the charge supplying member should not be voltage-dropped totally, the in case where an abnormal current arose through the charge supplying member due to pinholes on the photoconductor, or other cause.

Accordingly, in order to provide a charging member as described above, Japanese Patent Laid-Open hei-2 No. 62563 discloses use of a charging brush that is planted with the fibers looped substantially perpendicular to a rotational direction of the image bearing medium (photoconductor) formed on the photoconductor drum surface.

FIG. 5 is an illustration showing the structure, and there are disposed photoconductor drum 1 with an image bearing medium 1*a* (photoconductor). Reference numeral 5 designates a charging member having charging brush which is formed with conductive fibers 5*a* looped shown in the figure. The looped fibers 5*a* are planted on a conductive substrate 5*d* with a 5*g* conductive adhesive to thereby form charging brush 5. In this case, the photoconductor drum 1 rotates in a direction shown by arrow R, while the conductive fibers 5*a* are planted so that the loop structure is perpendicular to the moving direction of the photoconductor drum surface.

Using this means could reportedly inhibit stripe-like charging unevenness from occurring, compared to the conventional charging brush.

Meanwhile, charging members using such conductive fiber can be conceivably classified into two kinds, one of which is constructed as shown in FIGS. 2 and 5 such that a charging member is formed like a brush and fixed stationary in sliding contact with the surface of the photoconductive material 1*a*. The other type of the charging members is formed as a roll and the roll-shape member is brought into contact with photoconductive material 1*a* relatively with moving on the surface of photoconductive material 1*a*. The former one has a simple structure but exhibits a tendency that the fiber is built up with toner or other foreign substances, still likely causing charging unevenness. In the latter case, since the conductive fiber aggregation 5*a* moves, foreign substances is hard to build up, and an additional cleaning means might also be provided. Nevertheless, the structure becomes complicated, and when for example, the conductive fiber cloth is wound roll-shaped or belt-wise, the seam formed may cause charging unevenness.

Causes of thus occurring charging unevenness were studied, and the following views were realized.

First, it is generally known that the surface of photoconductor 1*a* will be charged when photoconductor 1*a* is brought into contact with conductive fiber aggregation 5*a* to which a voltage is applied. This electrification is conceivably caused both by discharge across the micro-clearance and by charge-injection from the contact points. The discharge across the micro-clearance starts to occur when the voltage across the clearance reaches a certain level. This voltage is determined by Paschen's rule of discharge, and an example of the relation is shown in FIG. 6. Once the discharge occurs, charges transfer all at once from conductive fiber aggregation 5*a* to photoconductor 1*a*. This transfer causes the surface potential of photoconductor 1*a* to heighten and then the discharge stops. Even after completion of the discharge, photoconductor 1*a* is still elevated in its surface potential by the injection of charges from the contacts points. For this reason, a portion which comes in touch with conductive fiber aggregation 5*a* in a longer time, or a portion which contacts thereto at a higher possibility will bear higher potentials. This can be realized as to be the cause of charging distribution unevenness appearing in broomed traces or seams of conductive fiber aggregation 5*a*.

On the other hand, charging unevenness of the stripe-type generated in the brush-type charger is mainly attributed to long-term contact of the brush-like charging member made up of conductive fiber against the same contacting point on the image bearing medium. In addition, such a contact over a long period of time not only rubs certain points on the image bearing medium repeatedly causing possible scratches and wounds on the medium, but also wears the brush itself quickly. To make the matter worse, the developer may gradually be built up in the tips of the brush resulting in pollution.

The adhesion of the developer to the ends of nap or fibers of the conductive fiber in the charger may deteriorate the fiber itself in its durability. Further, a long term contact of the charger onto the surface of the image bearing medium brings down the conductive fibers in a rotating direction of the medium, and the thus worn-out fiber cannot allow itself to keep uniform contact with the surface of the image bearing medium, causing non-uniformity of charging to generate charge-distribution unevenness.

Still, fibers are generally liable to absorb moisture, and fibers with dampness become too flexible, making it difficult for the fibers to stand upright. For this reason, once the fiber is exposed in a high humidity environment, the worn-out, or the state of being brought down of, the fiber cannot be cured.

Meanwhile, used as a photoconductive material for the photoconductor drum are organic semiconductors, CdS, SeTe, $As_3Se_2$, etc, of which organic semiconductors are mostly used. Typically, an N-type organic semiconductor bearing negative charges presents good attenuation characteristics in response to light exposure, but the same semiconductor bearing positive charges exhibits poor light-attenuation characteristics.

For this reason, when a positive transfer voltage, that is, the same polarity with the charging voltage, is applied by the transfer roller to the surface of the photoconductor drum even through a recording sheet therebetween and thereafter the recording sheet is separated from the photoconductor drum, the potential of the photoconductor drum surface to which the transfer voltage is not applied receives some influence. Accordingly, when the charging voltage is applied by the roller to the photoconductor drum after the transfer, a difference due to the aforementioned transfer voltage is caused to appear in the surface potential of the drum, by the electrificability of the charge roller. The difference in the surface potential has influence on image, causing fog and density irregularity in the final image.

There have been several proposals other than the above that use such charging means of contact type.

For example, Japanese Patent Application Laid-Open sho-59 No. 204859 discloses a means for preventing deterioration due to wear-out of a brush for use in a brush roller, planted with conductive fibers thereon as charging means, and contacted against a photoconductor. This mechanism is provided with a cum and a tracking roll in each end of the photoconductor and in each end of the brush roller, respectively, and the tracking rolls run on the cum surfaces and the tracking rolls step on respective projections disposed on the cums when the copier is out of operation, whereby the front ends of the brush are kept spaced from the surface of the photoconductor. However, such a structure not only increases the number of parts for the copier, but also requires control of the tracking rolls to step on the projections, and consequently the means cannot be realized as being very practical.

Another publication in Japanese Patent Application Laid-Open sho-60 No. 216361 discloses a means serving as both charging means and transfer means, comprising a roller or brush planted with conductive fibers to be brought in contact with a photoconductor, the means in which a first cycle performs a charging operation while a second cycle effects a transfer operation. In this case, a conductive member is applied by a combined voltage of a d.c. voltage and an a.c voltage of 20% or more of the d.c. voltage, where maximum and minimum values of voltage waveform for the a.c.-overlapped d.c. voltage are to be within ±200 to ±2000 volts. This measure requires no switching of the applied voltages between a charging operation and a transfer operation, and improves uniformity of charging as well as achieves an excellent transfer efficiency. However, since this means is oriented to suffice a special usage for effecting both charging and transfer operations, the structure tends to be complicated.

Another disclosure in Japanese Patent Application Laid-Open sho-64 No. 73367 shows a charging means constructed such that, in charging a photoconductor by bringing a contact-type charging member, such as a conductive roll, which is applied with a combined voltage of d.c. and a.c. voltages, into contact with the photoconductor, a portion by which the charging member is in contact with the photoconductor is formed with a resistance layer and a dielectric layer as a surface layer, and therefore a reactance of the charging member to a.c. voltage is smaller than the resistance of the charging means. Use of this means may prevent voltage-drop of the voltage supplying portion due to a leak even though pin-holes may happen to occur on the surface of the photoconductor, and thus the image unevenness that would be caused by the voltage drop will not occur. Here, according to this publication, it is described that the frequency of the a.c. voltage used should be within a range of 50 to 2000 Hz. This proposal was made mainly to eliminate the lowering of image quality attributed to wounds such as pin-holes and other defects arising on the surface of the photoconductor, therefore, the concept on which the technology is based is quite different from what the present invention intends to achieve.

SUMMARY OF THE INVENTION

It is therefore an object of the present invention to provide a charging method in the electrophotographic process and an image forming device using a conductive fiber aggregation in its image forming means, the method and device which can reduce charging unevenness occurring due to broomed traces and seams of conductive fiber aggregation and assure stable charging all the time, by inhibiting the partial elevation of the surface potential of the dielectric layer, caused by the charge injection in the contacting portion between the conductive fiber aggregation and a photoconductor or photoconductive dielectric layer.

It is another object of the invention to provide an electrophotographic copier using as its charger a brush-type charging part composed of conductive fibers, the copier which can prevent unevenness caused in the paper feed direction, reduce wear-out of the brush tips and damage of the image bearing medium and further eliminate the accumulation of developer piled up in the brush tips that would bring about a pollution.

It is a further object of the invention to provide an electrophotographic copier using a charger device composed of conductive fiber, the copier in which adhesion of residual developer that could not be removed from an image bearing medium surface by a cleaning blade onto the tips of conductive fibers of the charging device; wear-out of the conductive fibers of the charging device being laid down in the rotational direction of the image bearing medium; and wear-out of the fibers due to the change of environment; can be eliminated even when the charging device is brought into a long term contact with the image bearing medium or the surface of the photoconductor, whereby the adhered developer to the conductive fibers can be prevented from contacting the image bearing medium surface and therefore damaging the image bearing medium surface, charging unevenness can be inhibited, and the life of the conductive fiber itself can be increased.

It is still another object of the invention to provide an image forming device in which, by providing a charging device of roll-shaped conductive fiber for an image forming device used in the electrophotographic process, failure of charging can be lessened and life of the fiber is improved and which is able to offer a final image with high quality free from defects due to charging unevenness, by properly limiting the condition of plating fibers and the relational ratio between the peripheral velocities of charger device and photoconductor drum.

It is still further object of the invention to provide a method of applying charging voltage when the aforementioned conductive roller type charger and a fixing unit is used in an image forming device, the method by which the unevenness or difference in charged surface potential on an image bearing medium generated by transfer voltage can be reduced.

In summary, the object of the present invention is to solve the conventional problems such as occurrence of charging unevenness and/or defects and to provide an image forming device and charging means therefore which is able to offer images with good quality as well as being durable and inexpensive.

The present invention has been performed in order to achieve the above objects, and the objects of the invention can be achieved by the following configurations.

A first aspect and feature of the invention is in that an electrophotographic copier, equipped with a conductive roller or a conductive brush as a charging device of contact type for effecting an electrophotographic copying process, is constructed such that the charging device comprises an aggregation of conductive fiber formed like a roll; and clearance keeping members, disposed at least in both ends of the roll-like aggregation of conductive fiber, and when a photoconductive dielectric layer is to be charged by bringing the conductive aggregation of fiber into contact therewith, the clearance keeping members come in contact with the surface of the photoconductive dielectric layer at both ends thereof for keeping a predetermined clearance, so that the roll-like aggregation of conductive fibers is rotated through the clearance keeping members following the rotation of photoconductive dielectric layer.

With this construction, the charging device is allowed to be in secure contact with the surface of the photoconductive dielectric layer and to rotate a substantially equal rate with the movement of the aforementioned surface, so that the mechanical friction on the surface is reduced. As a result, not only can the charging unevenness be eliminated, but also the durability of both the aggregation of conductive fiber and the photoconductive dielectric layer can be improved.

A second aspect and feature of the invention lies in a charging means used in an electrophotographic copier, equipped with a conductive roller or a conductive brush as a charging device of contact type for effecting an electrophotographic copying process, being constructed such that the charging device comprises an aggregation of conductive fiber, and, when a photoconductive dielectric layer is to be charged by bringing the conductive aggregation of fiber into contact therewith, the aggregation of conductive fibers is impressed with a periodically oscillating voltage having a lower boundary voltage higher than a desired surface potential of the photoconductive dielectric layer.

When the photoconductive dielectric layer is charged by bringing the conductive aggregation of fiber into contact therewith, charges would be injected from the contact portion after completion of charging by discharge, causing charging unevenness and thus lowering the quality of the image. But with the arrangement described above, charging unevenness can be eliminated by the method since an oscillating voltage is generated by combining an a.c. voltage with a d.c. voltage required for charging so as to have a lower boundary voltage of a desired surface potential of the photoconductive dielectric layer and the thus generated oscillating voltage is applied to the aggregation of conductive fiber.

In this case, it is effective that the oscillating voltage impressed to the aggregation of conductive fiber has a frequency of 100 Hz or more, and that a moving velocity of the aggregation of conductive fiber is substantially equal to that of the photoconductive dielectric layer.

A third aspect and feature of the invention is in an electrophotographic copier, equipped with a conductive roller or a conductive brush as a charging device of the contact type for effecting an electrophotographic copying process, being constructed such that the charging device comprises an aggregation of conductive fiber formed like a brush and vibrating means to vibrate the aggregation of conductive fiber, and when an image bearing medium is to be charged by bringing the brush-like charging member into contact therewith, the aggregation of conductive fiber is vibrated by the vibrating means, in a state in which the aggregation of conductive fiber is kept in contact with the image bearing medium.

In this construction, since the charging member is vibrated in the contacting state, the continuous stationary contact at the same points between the charging member and the image bearing medium can be prevented. As a result, it is possible to prevent charging unevenness from occurring and reduce wear-out of tips of the brush and damage of the image bearing medium.

A forth aspect and feature of the invention lies in an electrophotographic copier, equipped with a conductive roller or a conductive brush as a charging device of the contact type for effecting an electrophotographic copying process, being constructed such that the charging device comprises: an aggregation of conductive fiber formed like a brush; vibrating means to vibrate the aggregation of conductive fiber; and a comb-like vibration regulating member held across an entire part of the aggregation of conductive fiber, and when an image bearing medium is to be charged by bringing the brush-like charging member into contact therewith, the aggregation of conductive fiber is vibrated by the vibrating means while being regulated by the comb-like vibration regulating member, in a state in which the aggregation of conductive fiber is kept in contact with the image bearing medium.

In this construction, since the developer powder likely to be built up onto tips of the brush is always dusted away by the combination use of the vibration of the charging member and the regulating member, no accumulation of the developer powder occurs, making it possible to avoid pollution.

In this case, it is effective that the charging member is vibrated in a direction substantially perpendicular to the rotational direction of the image bearing medium and that the charging member is vibrated with a frequency of 1 Hz or more.

A fifth aspect and feature of the invention resides in an electrophotographic copier, equipped with a conductive roller or a conductive brush as a charging device of the contact type for effecting an electrophotographic copying process, wherein an image bearing medium is charged by bringing a charging device into contact therewith, and a developer of the same polarity with the charging potential of the image bearing medium is used, the charging device comprising: a conductive, cylindrical substrate having on its surface a plurality of through-holes through which cold or hot air can be passed; and conductive fiber formed like a brush and planted on the surface of the substrate.

In this construction, since hot or cold air is ventilated from the roots to the tips of the conductive fibers so as to blow out the developer particles adhered to the conductive fibers and so that the fibers can be kept upright, it is possible to prevent the fibers from being worn out and falling down toward the rotational direction of the image bearing medium. It is more effective to eliminate the wear-out of the fibers at a high-humidity environment when an air stream generated in heating means of a fixing unit is introduced for this use.

A sixth aspect and feature is that an electrophotographic copier, equipped with a conductive roller or a conductive brush as a charging device of the contact type for effecting an electrophotographic copying process, has configurations described in the fifth aspect and feature, and further comprises a closed container having an air-exhausting means, preferably with a filter, and enclosing the charging device.

In these configurations, it is preferable that an air stream that is generated in a heating means of a fixing unit of the electrophotographic copier, is introduced into the cylindrical substrate of the charging device through an air duct optionally provided as required.

By this method, the effect described immediately above can be further intensified, and the sucking collection of the residual developer and the protection of wear-out of the conductive fiber by dehydration can additionally be improved. Therefore, the damage of the surface of the image bearing medium caused by the contact between the surface and the residual developer and/or the occurrence of charging unevenness can be effectively inhibited, to thereby improve the life of the conductive fiber itself.

A seventh aspect and feature of the invention lies in that an electrophotographic copier, equipped with a conductive roller or a conductive brush as a charging device of the contact type for effecting an electrophotographic copying process, comprises a photoconductor drum and a charging device of roll-shaped body with conductive fiber or an aggregation thereof planted thereon, wherein a photoconductive layer on the photoconductor drum is charged by bringing the charging device into contact therewith while the photoconductor drum and the roll-shaped body are individually being rotated with a voltage impressed therebetween, is constructed such that planting intervals between fibers and a ratio of a peripheral velocity of rotation of the photoconductor to that of the roll-shape are limited so that, a product, $d1 \times d2 \times (Vp/Vr)$ is smaller than the average size of developer particles used in the electrophotographic process, where d1 is a planting interval between fibers in the rotational direction of the roll-shaped body with the conductive fiber of an aggregation planted thereon; d2 is an interval between fibers in the axial direction of the roll-shaped body; Vr and Vp are peripheral velocities of rotation, respectively, of the roll-shaped body forming the charging device and the photoconductor drum, and therefore, (Vp/Vr) indicates a ratio of peripheral velocity of rotation.

In this apparatus, by regulating the three values, that is, the planting intervals of the fibers in the rotational direction of the roller and in the direction of the rotational shaft, and the ratio of peripheral velocity of rotation of the photoconductor to that of the roller, that area on the surface of the photoconductor which may fail to be charged or tends to be charged faultily can be smaller than the particle size of developer used in the image forming. Accordingly, a defect on the final image can be freed.

An eighth aspect and feature of the invention is characterized by a charging means used in an electrophotographic copier, equipped with a conductive roller or a conductive brush as a charging device of the contact type for effecting an electrophotographic copying process, the charging device comprising conductive roll-shaped charging means, through which charging voltage is applied to an image bearing medium, being constructed such that the charging voltage is changed over between two levels so that, when an image is formed, different voltages of charging can be applied to a region with transfer voltage having been applied thereto and a region without transfer voltage applied thereto, respectively.

In this structure, since a voltage applied by the charging means to the region, of the image bearing medium, subjected to the transfer is changed such that the region may be charged with the same surface potential with the region not subjected to the transfer, the irregularity or difference of the surface potential on the image bearing medium can be lessened.

A ninth aspect and feature of the invention lies in that an electrophotographic copier, equipped with a conductive roller or a conductive brush as a charging device of the contact type for effecting an electrophotographic copying process, comprises: a charging roller having conductive fiber covered on a surface thereof; a dirt preventing member disposed in alignment with a longitudinal direction of the charging roller so as to be shifted between a uniformly contacting position with the charging roller and a spaced position therefrom; and means for bringing the dirt preventing member into uniform contact with the conductive fiber on the charging roller surface when the charging device is in operation and in contact with a photoconductor so as to clean the surface of the conductive fiber on the charging roller, and for retracting the dirt preventing member from the charging roller when the charging device is out of operation.

With the structure described above, the residual toner and foreign substances adhered to the conductive fibers can be dusted away by the dirt preventing member when the apparatus is engaged whereas the conductive fibers can be kept upright when the apparatus is disengaged.

DETAILED DESCRIPTION OF THE PREFERRED EMBODIMENTS

Now, referring to the accompanying drawings, description in detail will hereinafter be made on an embodiment of an electrophotographic copier to which the present invention is applied.

Figure 7:
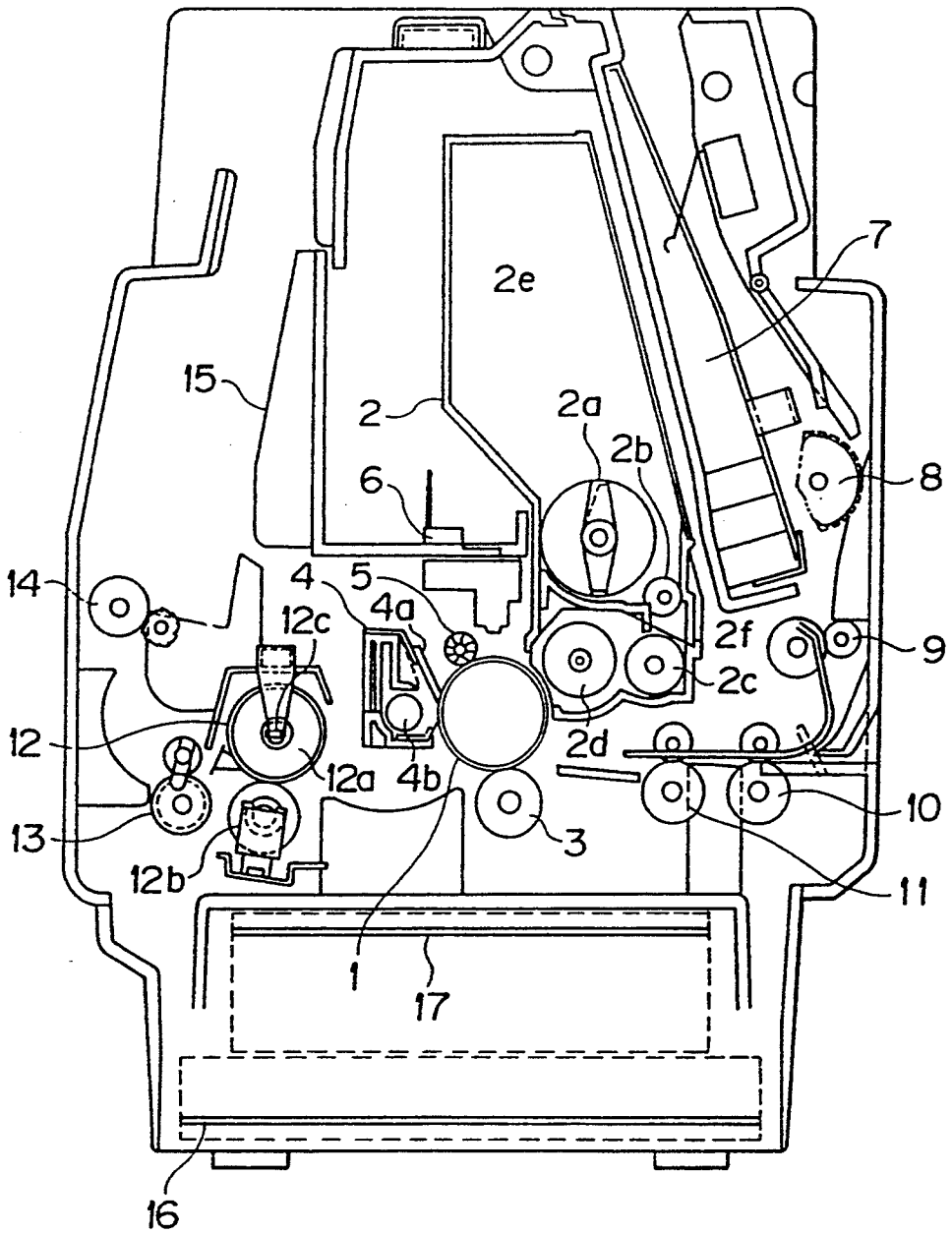
FIG. 7 is a schematic illustration showing an embodiment of an electrophotographic copier to which the present invention is applied.

FIG. 7 is a schematic illustration showing an embodiment of an image forming apparatus according to the present invention. First of all, configurations of the embodiment shown in FIG. 7 will be explained.

In the figure, a reference numeral 16 designates a controller for processing image-generating data transmitted from an unillustrated host computer, and another reference numeral 17 designates an engine controller for controlling an activation of the image forming apparatus in response to a signal dictating start of image forming, sent from the controller 16.

A reference numeral 7 indicates a cassette for holding transfer material such as copy sheets. An arrangement is made such that a sheet is drawn out from cassette 7 by a paper feed roller 8 and conveyed by a series of conveyer rollers 9, 10 to a resist roller 11.

A photoconductor drum 1 has a photoconductive dielectric layer thereon, and is rotated at a constant rate by driver means (not shown) in a clockwise direction in FIG. 7. Disposed clockwise around the photoconductor drum 1 are a charger 5 made mainly of conductive fiber aggregation, an exposure-writing head or exposure unit 6, developing unit 2, a transfer unit 3 including a transfer roller, and a cleaner 4.

The developing unit 2 comprises a toner tank **2*e* having an agitating roller 2*a* therein, and a developer tank 2*f* having a magnet roller 2*d* for electrifying the toner and a mixing roller 2*c* for mixing the toner supplied by a supplying roller 2*b* from toner tank 2*e***.

The cleaner 4 is provided in a form of a cleaning unit comprising mainly a cleaning blade **4*a* for scraping the toner from the surface of photoconductor drum 1 and toner conveying screw 4*b*** for conveying the scraped toner to a container (not shown) for collecting the used toner.

Meanwhile, a copy sheet that has passed through a place between transfer unit 3 and photoconductor drum 1 is fixed by a fixing unit 12 which comprises a heat roller **12*a* having a heater 12*c* built therein and a pressure roller 12*b*. The fixed copy material is conveyed by a conveying roller 13 and a paper discharging roller 14 to a stack guide 15**.

Next, description will be made on operation of the embodiment of the invention shown in FIG. 7.

First, data for image generation is sent from an unillustrated host computer to controller 16 to be processed therein. Then, a signal dictating start of image formation is sent out to an engine controller 17. From then on, the operation proceeds following a predetermined procedure.

Next, a transfer material such as copy sheets held in transfer material-holding cassette 7 are drawn out sheet by sheet by means of paper feed roller 8 to be conveyed through conveyer rollers 9, 10 up to the near side of resist roller 11. Photoconductor drum 1 is driven at a constant rate by the unillustrated rotating mechanism in a clockwise direction in FIG. 7. At the time, charger 5 having conductive fiber aggregation **5*a* thereon is rotated such that the fiber aggregation 5*a* is in contact with photoconductor drum 1 with a constant bite (degree in which the fiber would cut into the drum) regulated by clearance keeping members 5*b*. In this phase, charger 5 is applied with a combined voltage of, for example, −1000 V plus an a.c. voltage of 200 V (Vp-p), whereby the surface of photoconductor drum 1 will be charged uniformly at a desired voltage (for example, −600 V). Alternatively, a d.c. voltage of −1200 V, for example, may be impressed to uniformly charge the surface of photoconductor drum 1**.

In developing unit 2, in order to assure that magnet roller **2*d* may provide toner having a predetermined toner density, toner powder is supplied from toner tank 2*e*, as required, by supplying roller 2*b* to developer tank 2*f*, and the thus supplied toner powder is agitated by mixer roller 2*c*. During the agitation, the toner is electrified to bear charges of the same polarity with that of the voltage to be charged onto the photoconductor. In this state, when a voltage close to the charging voltage of the photoconductor is applied to the magnet roller, the toner powders adhere to portions that exposure unit 6** as an exposure writing head has irradiated, and thus the latent image is visualized.

Next, resist roller 11 sends out a transfer material or copy sheet, etc. by measuring a timing so that the sheet may be positioned corresponding to an image on photoconductor drum 1. The transfer material is held between, and conveyed by, photoconductor drum 1 and transfer unit 3.

During this operation, transfer unit 3 is impressed by a voltage of an opposite polarity to that of the toner. This is why the toner particles on photoconductor drum 1 move onto the transfer material. The toner particles on the transfer material are sandwiched between, and conveyed by, heat roller **12*a* with heater 12*c* incorporated therein and pressure roller 12*b*. In this phase, the toner particles are molten and fixed on the transfer material. Then, the transfer material is conveyed by conveying roller 13 and discharging roller 14 to stack guide 15. Meanwhile, toner that has not transferred and remains on the photoconductor drum 1 is scraped from the photoconductor drum 1 by cleaning blade 4*a* of cleaner 4. The scraped toner is sent by a toner conveying screw 4*b*** to the used toner correcting container (not shown). This is a complete series of image forming process.

In the invention, publicly known conductive fiber can be used as the conductive fiber constituting the charging member.

An example of the conductive fiber is "REC", a product of UNITIKA or an equivalent that is made of a rayon fiber to which carbon particles are uniformly dispersed so as to have a desired resistance. An alternate example is "BELLTRON", a product of Kanebo, LTD. or an equivalent that is a conductive polyamide fiber. Besides these, any material can be selected and used properly.

These conductive fibers can be formed into a padcloth, which in turn is adhered with, for example, a conductive adhesive to a conductive substrate to make a charging brush. The thus formed charging brush can be used as the charging member that is made in contact with the photoconductor drum. As an alternate embodiment, the thus formed conductive fiber cloth can be swathed spirally to form a conductive fiber member of a roller type.

Next, main aspects and features of the present invention will be described with reference to the embodiments.

An embodiment of the first aspect and feature of the invention will hereinafter be described.

Figure 8:
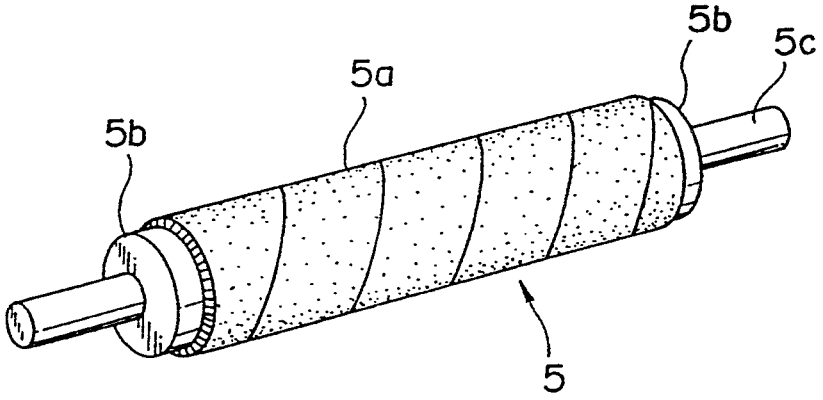
FIG. 8 is an oblique view showing an example of a charging member used in an electrophotographic copier to which the present invention is applied.

FIG. 8 is an oblique view of a charging member 5 used in an image forming apparatus of the invention. In this figure, a reference numeral **5*c* designates a shaft for rotatably supporting a roller body on which the fiber aggregation 5a is swathed. At the vicinity of both extremes of the shaft 5c, a clearance keeping members 5b having an outer diameter slightly smaller than that of the fiber aggregation are attached adjoining the aforementioned fiber aggregation 5a**.

With respect to a material used to make the charger 5, a cloth of a synthetic fiber such as rayon, etc. onto which conductive granular material such as carbon powder is dispersed, can be used again as the conductive fiber aggregation 5a. In the embodiment shown in FIG. 8, the thus formed conductive fiber is wound spirally on the shaft 5c to form a roll of the fiber aggregation 5a.

As the clearance keeping members 5b, hard rubber materials can be used. The rubber material is shaped into a short-height cylinder having an outer diameter slightly smaller than that of the aforementioned fiber aggregation 5a, and the thus formed cylinders can be press-fit to the shaft 5.

Figure 9:
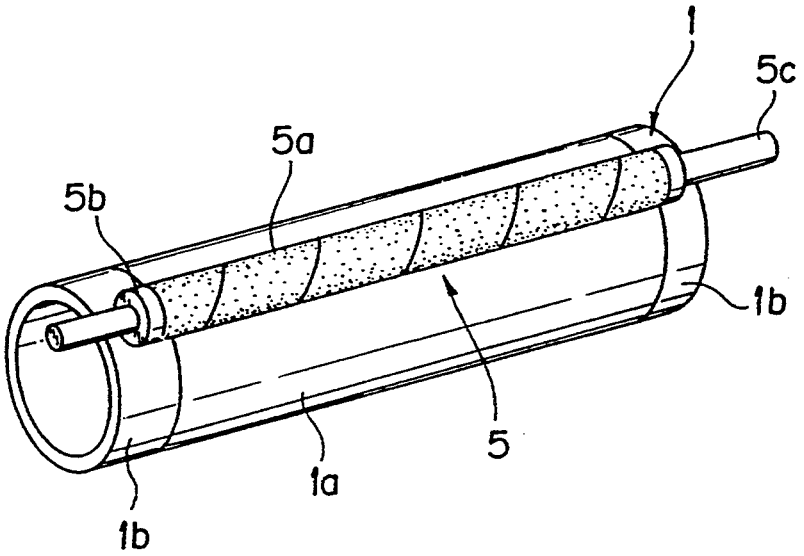
FIG. 9 is an oblique view showing positional relation of a photoconductor drum and the charging member shown in FIG. 8.

FIG. 9 is an oblique view showing a positional relation between a photoconductor drum 1 and the charger 5 shown in FIG. 8. In the figure, the photoconductor drum 1 comprises a metal drum 1b of aluminum as a substrate of the photoconductor drum and a photoconductive dielectric layer 1a disposed therearound. As is shown in the figure, charger 5 is disposed and supported such that conductive fiber aggregation 5a comes in contact with the dielectric layer 1a and clearance keeping members 5b are in direct contact with metal drum 1b, that is, the end portions of the photoconductor drum 1 on which no dielectric layer 1a is covered. As being thus constructed, the conductive fiber aggregation 5a can rotate following the rotation of photoconductive dielectric layer 1a, as described above.

Now, a specific example of charger 5 for use in an electrophotographic copier of the invention will be referred to. In the embodiment shown in FIG. 9, a conductive roller shaft of 6 mm in diameter is used as the shaft 5c, around which a conductive fiber cloth made of a rayon cloth of 20 mm wide with carbon powder dispersed thereon is swathed spirally to form a roll of conductive fiber aggregation 5a. Clearance keeping members 5b formed of a hard rubber material having an outer diameter of 10 mm are pressingly fit in and fixed at both ends of the thus formed conductive fiber aggregation 5a. The clearance keeping members 5b are in contact with metal exposed portions of the photoconductor drum 1 or the aluminum drum 1b to be driven thereby. Therefore, a smooth sliding can be performed and of course, no charging unevenness occurs.

It should be noted that the apparatus of the invention is not to be limited to the above embodiment, charger 5 may be, for example, equipped with an individual driver means (not shown) such as a motor or the like. Besides, conductive fiber aggregation 5a can be made belt-typed.

An embodiment of the second aspect and feature of the invention will hereinafter be described.

Figure 1:
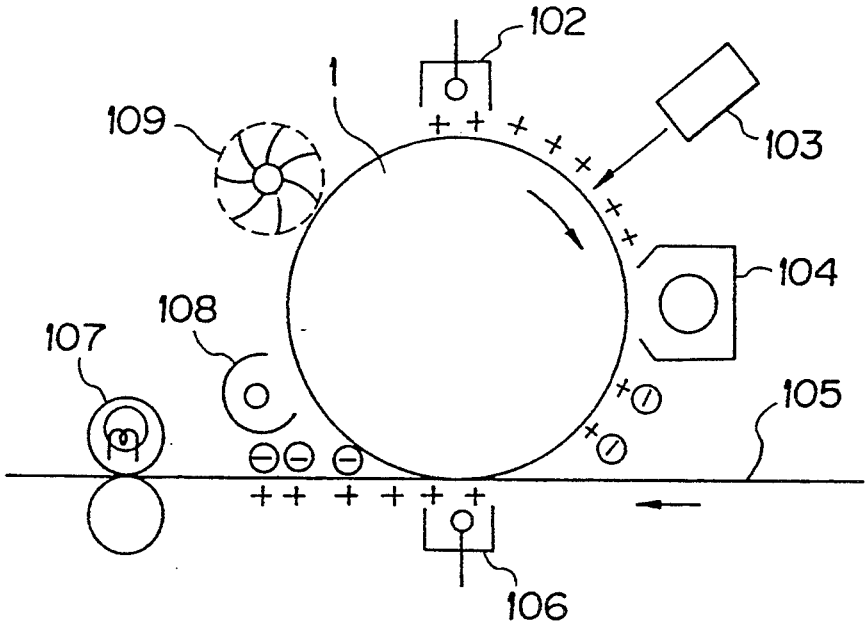
FIG. 1 is a schematic view showing basic configurations of an electrophotographic copier.
Figure 2:
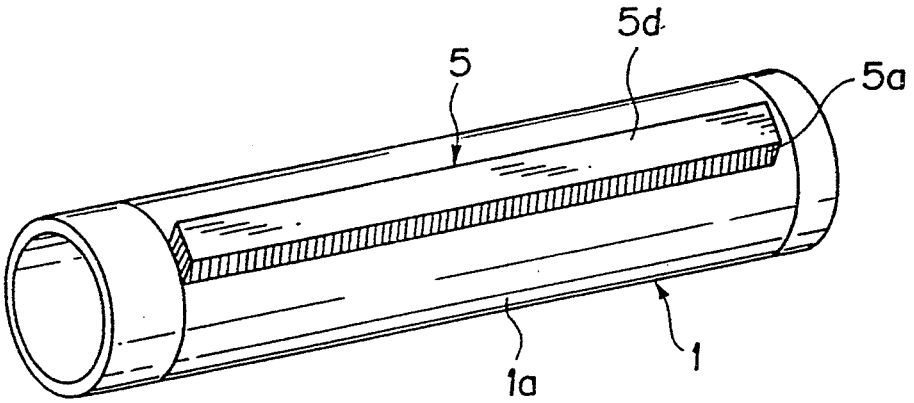
FIG. 2 is an oblique view showing an example of a conventional charging means.
Figure 3:
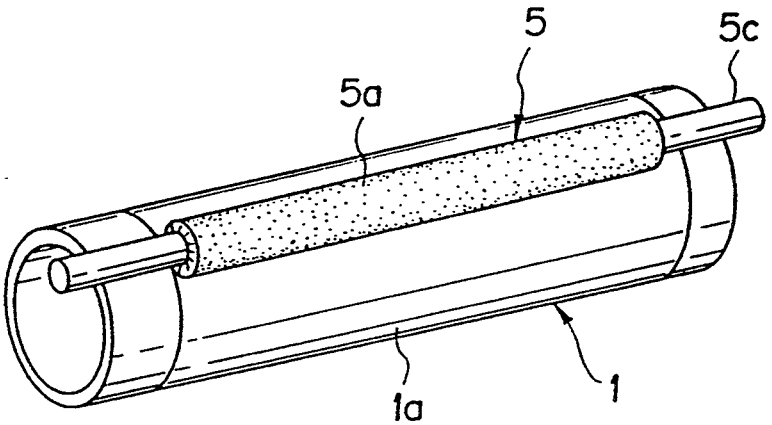
FIG. 3 is an oblique view showing another example of a conventional charging means.
Figure 4:
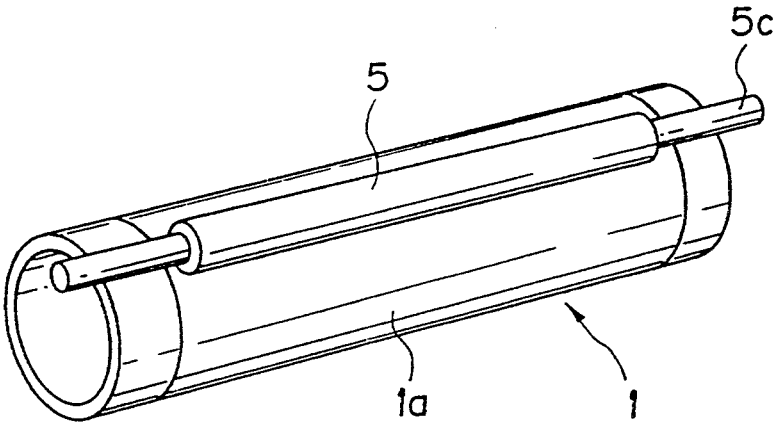
FIG. 4 is an oblique view showing a further example of a conventional charging means.
Figure 5:
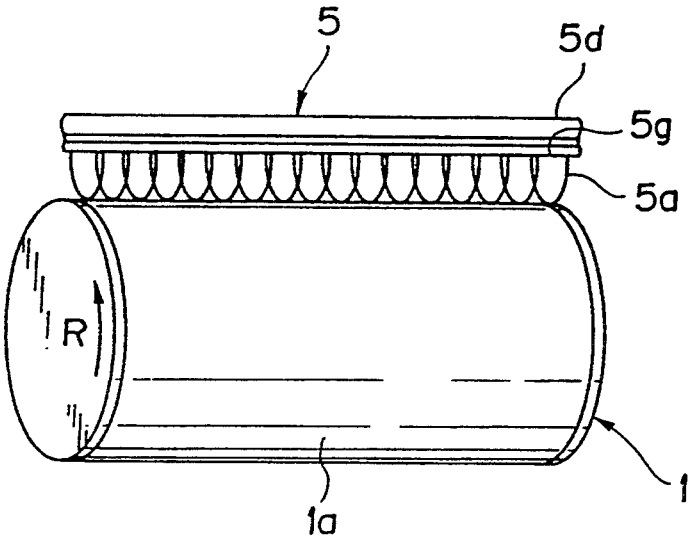
FIG. 5 is an illustrative view showing still another example of a conventional charging means.
Figure 6:
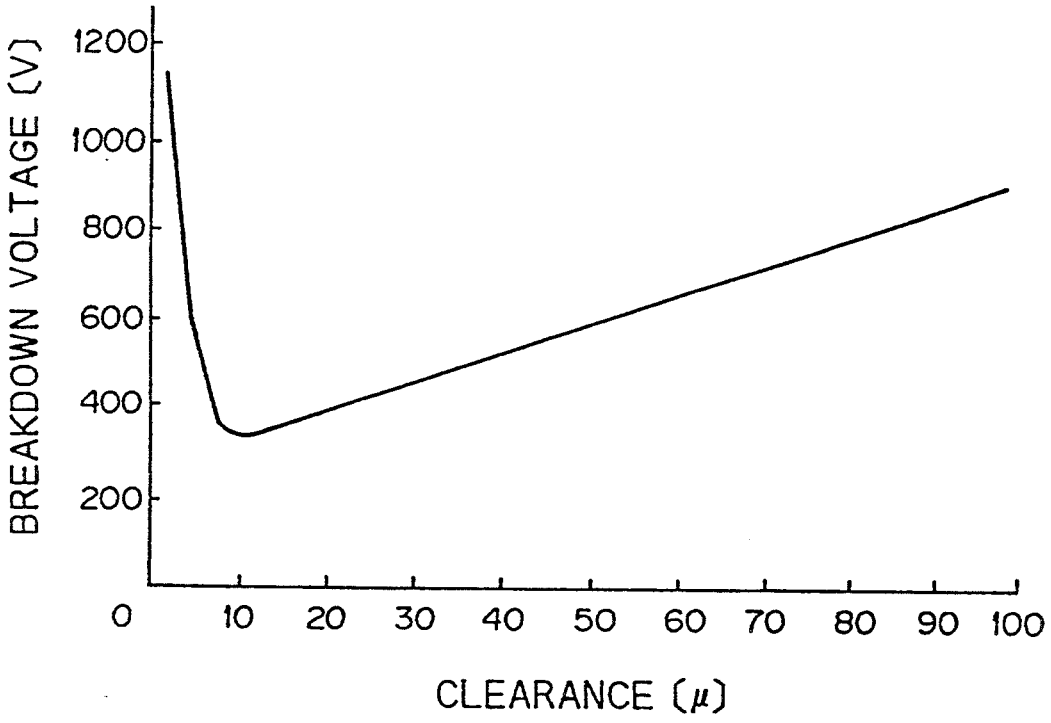
FIG. 6 is a plot showing an example of characteristics of Paschen's discharge.

At the beginning of description of the embodiment, a mechanism of charging the photoconductive dielectric layer using the conductive fiber aggregation occurs. In a portion where the dielectric layer is brought in contact with the conductive fiber or specifically the tips of fibers, charges move from places with a higher potential to places with a lower potential, while discharge occurs in accordance with the Paschen's discharge characteristics as exemplarily shown above in FIG. 6, in a portion where the dielectric layer is spaced certain distances from the conductive fiber, specifically, for example, in the vicinity of the contact portion or on the side portion of the conductive fibers. The discharge will stop when charges on the conductive fibers move to the dielectric layer side and the potential difference across the clearance becomes lower than the discharge threshold level. After the completion of discharge, injection of charges still lasts, since the conductive fiber aggregation is in contact with the photoconductive dielectric layer, thus the surface potential in the contact portion increases, causing charging unevenness, as discussed above.

Therefore, in the embodiment, during the charging process an a.c. voltage is overlapped to a d.c. voltage required for the charging so as to make a periodically varying voltage that has a lower limit higher than a desired surface potential of the photoconductive dielectric layer. Application of the thus created varying voltage to the conductive fiber aggregation can solve the problem of the above-described charging unevenness all at once.

In this case, the oscillating voltage is preferably small, but if the lower limit of the varying voltage is lower than the desired surface voltage, charges might possibly be injected inversely from the photoconductive dielectric layer toward the conductive fiber aggregation. This is why the lower limit of the oscillating voltage should be higher than a desired surface voltage.

An effective frequency of the oscillating voltage is 100 Hz or more, and in case of less than 100 Hz, it becomes quite difficult to inhibit the appearance of charging unevenness caused by the varying voltage. In contrast, no limitation is particularly specified for the upper limit of the frequency, but since the charging system includes a capacitive component, an excessively high frequency makes the system unable to follow the oscillating voltage, only to lower the efficiency. Accordingly, 1,000 Hz or less frequency is suitable in practice.

In charging, it is necessary to establish a secure contact between the fiber aggregation and the dielectric layer. Besides, it is preferable to reduce the mechanical rubbing between the both in view of improvement in durability of the both elements.

As described above, in the invention, it is effective to use a charging member, as shown in the feature of the first invention, that is constructed such that a roll-shaped conductive fiber aggregation is rotatably supported by a shaft, and clearance keeping members having an outer diameter slightly smaller than that of the conductive fiber aggregation are fit in adjacent to the both ends of the fiber aggregation, whereby the fiber aggregation can come in secure contact with the dielectric layer and rotate at substantially the same rate with the rotation of the dielectric body, following the rotation thereof. The thus constructed means, upon a charging process effected by the contact between the conductive fiber aggregation and the photoconductive dielectric layer, inhibits the partial elevation of the surface potential of the dielectric layer and therefore reduces charging unevenness occurring due to broomed traces and seams of conductive fiber aggregation, making it possible to assure a stable charging operation in a prolonged period of time.

The specification of the oscillating voltage applied to charger 5 is not strictly limited to the above value, as long as the voltage has a lower limit higher than that of a desired surface potential and can generate a desired surface potential in total. Moreover, various kinds of waveforms such as chopping waves, pulsing waves, etc. other than alternating waves can be properly selected.

An embodiment of the third aspect and feature of the invention will hereinafter be described.

Figure 10:
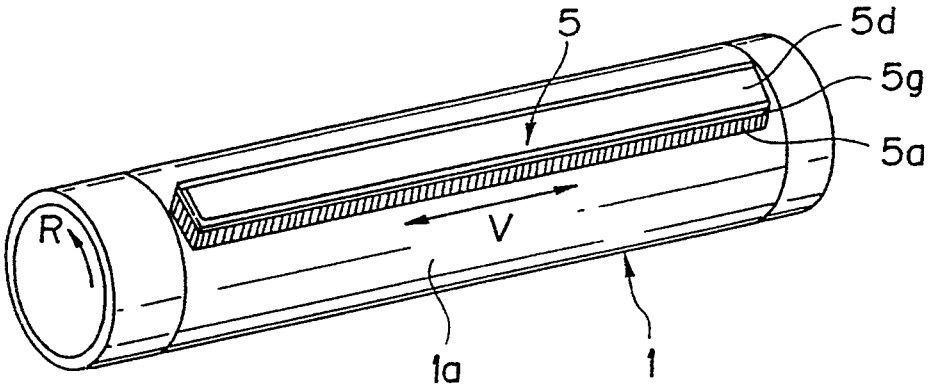
FIG. 10 is an oblique view showing positional relation of a charger of the invention to a photoconductor drum.

FIG. 10 is an oblique view showing a positional relation between a charger and a photoconductor drum of the invention. In the figure, reference numerals 1 and 1*a* designate a photoconductive drum and an image bearing medium (a photoconductor). A charger 5 comprises conductive fibers 5*a* as charging part planted on a conductive substrate 5*d* with a 5*g* conductive adhesive, to thereby form a charging brush.

In this case, photoconductor drum 1 rotates in a direction of arrow R, whereas the charging brush, i.e, charger 5 that is in contact with the surface of image bearing medium 1*a* is provided with a vibrating means so that the charger moves right and left in the indicated directions V (in a perpendicular direction to direction R).

Now, an embodiment of means for vibrating charger 5 will be described with reference to the drawings.

Figure 11:
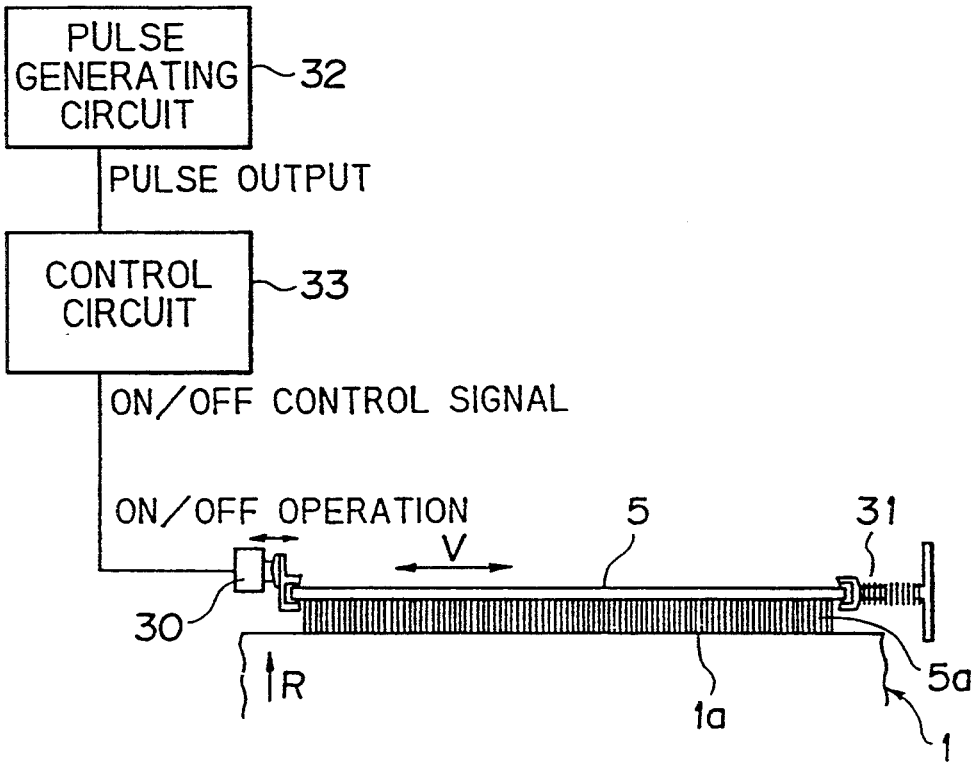
FIG. 11 is a conceptual diagram showing an embodiment of an arrangement including an oscillating means according to the invention.

FIG. 11 is a conceptual illustration showing an embodied arrangement of means for causing vibration of charger 5 in accordance with the invention.

In FIG. 11, charger 5 made up of the charging brush comprising conductive fibers 5*a* in contact with image bearing medium 1*a* or the surface of photoconductive drum 1, is provided with a vibrating means 30 at its one end. In addition, the other end of the charger is equipped with a reacting means 31 such as a spring. A control circuit 33 receives a pulse output from a pulse generating circuit 32, and outputs an ON/OFF control signal to the vibrating means 30. Receiving the ON/-OFF control signal from control circuit 33, the vibrating means 30 causes vibration. Here, publicly known devices such as solenoid, ceramic vibrator, etc. can be used properly as the vibrating means 30. For the means, it is preferable to employ a device that can make a stable, short-periodic vibration.

Figure 12:
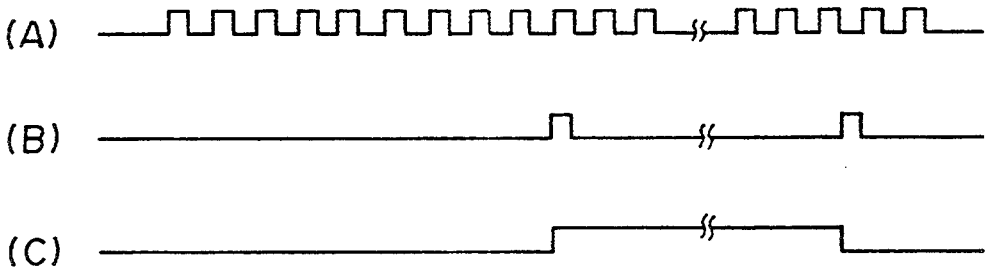
FIG. 12 is a timing chart of operational sequence of a control circuit in FIG. 11.

Next, the operation of the vibrating means shown in FIG. 11 will be described with reference to a timing chart shown in FIG. 12, in which operation sequences of control circuit 33 are represented.

The vibration of charger 5 is effected using a counter to count pluses generated from pulse generating circuit 32. For example, as shown in FIG. 12, the counter outputs a counter signal (shown in (B)) every time it counts ten clock pulse signals (shown in (A)). The output pulse is inputted into control circuit 33 so that the rising edge is detected. Every time the rising edge is detected, the control circuit 33 sends out an ON/OFF control signal to a switch incorporated in vibrating means 30. The signal activates the vibrating means to vibrate, and in synchronization with this, charger 5 moves back and forth in the directions of arrow V. By this vibration, the charging part or conductive fibers 5*a* of the charging brush as a part of charger 5, is moved back and forth in a direction substantially perpendicular (in FIG. 11) to the moving direction R of image bearing medium 1*a* disposed on the surface of photoconductor drum 1. As a result, the charging part (that is, fibers 5*a*) will not contact with image bearing medium 1*a* continuously at the same points.

It is effective to provide a reacting means 31 such as a spring in the other end of charger 5 in order to help the charger to return to home position when the vibrating means 30 is turned off. This mechanism allows the vibrating operation in the directions V to be effected more assuredly. In this case, it is most preferable and effective that the directions V of the back-and-forth movement is fixed substantially perpendicular to the rotational direction R of the photoconductor drum, in the view point of preventing charging unevenness of stripe type.

The vibration frequency of vibrating means 30 is preferably taken as fast or high as the charging part can follow, and if it is too slow or low, charging unevenness might possibly occur in the paper feed direction when the charging part made of conductive fibers 5*a* is vibrated in a direction perpendicular to the rotational direction R of image bearing medium 1*a*. Vibrating at a high frequency can prevent charging unevenness which would otherwise be caused by contact of the tips of the conductive fibers in a long time with the same points of the surface of image bearing medium 1*a*. Besides, the first vibration can shake down the remaining, polluting developer adhered to the charging brush.

A preferable vibration frequency in this case is more than 1 Hz, and an upper limit is in particular unspecified. In practice, the optimal frequency is 60 Hz or therearound, and acceptable practical vibration frequency may be conceivably 300 Hz or less.

Under the condition described above, when charger 5 is applied with a d.c. voltage of one and a half times as high as that of image bearing medium 1*a*, the charging unevenness problematic up to now can be inhibited.

An embodiment of the fourth aspect and feature of the invention will hereinafter be described.

Figure 13:
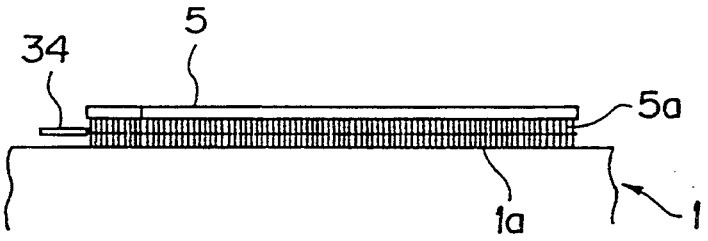
FIG. 13 is a conceptual diagram showing an embodiment of an arrangement including an oscillation regulating means according to the invention.

FIG. 13 is a conceptual illustration showing an embodiment of configurations in which a vibrating regulating member is used in accordance with the invention.

Figure 14:
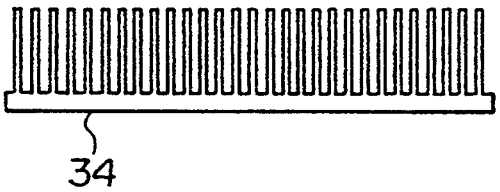
FIG. 14 is a plan view of an oscillation regulating means according to the invention.
Figure 15:
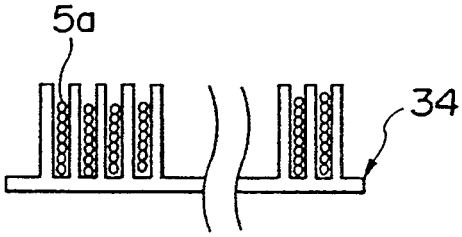
FIG. 15 is a plan view showing a situation of an oscillation regulating means being used.

The arrangement shown in FIG. 13 is basically similar to that of FIG. 11, but, in FIG. 13, a comb-like vibration regulating member 34 is held through across the whole part of conductive fibers 5*a* as a charging part constituting charger 5. The vibration regulating member 34 has a comb-like shape as shown in a plan view of FIG. 14. In a plan view of FIG. 15, conductive fibers 5*a* are shown as if they fill spaces between teeth of the comb, but in practice, the member 34 is held through such that the "comb teeth" themselves penetrate into between the fibers 5*a*. With respect to these drawings, particularly for FIG. 13, a vibrating means 30 and its control system as well as a reacting means 31, all shown in FIG. 11 are omitted for simplifying the drawing, but theses elements should of course be provided for the embodiment of FIG. 13.

The vibration regulating means 34 is fixed at, at least, its one end by a fixing means (not shown) so that the vibration thereof can be inhibited.

Now, the operation of the apparatus shown in FIG. 13 will be described.

Operation of vibrating the charging part is performed in a similar manner as described in the embodiment of FIG. 11.

Meanwhile, in the conventional apparatus, once the developer particles left, adhered on the surface of image bearing medium 1*a* stick to the fibers 5*a*, the developer particles are hard to fall down, and this would an uneven type to generate unevenness of stripe and damage the surface of image bearing medium 1*a*. In contrast in the apparatus of FIG. 13, since vibration regulating means 34 is held through while fixed, at least, at its one end, when the charging part is vibrated by vibrating means, each of conductive fibers 5*a* constituting the charging part is restricted as if the fibers strike the sides of the teeth of the comb every trip of vibration. Accordingly, even when the residual developer particles would stick to the fibers 5*a* as described above, the developer sticking thereto can be shaken down by the combination of vibration and the vibration regulator described above, and therefore the aforementioned problems are all settled.

The effect of the invention will now be cleared with reference to practical examples.

At first, a running copy operation was practiced in the apparatus configurated as shown in FIG. 11, with the charging member in contact with the image bearing medium and the vibration off. In this case, charging unevenness in the paper feed direction occurred after about 5,000 copies, and charging unevenness stretched over the whole image surface of paper after about 10,000 copies. With respect to the density or degree of the unevenness, it was relatively light around 5,000 sheets, but it became considerably distinct when the number of copies reached about 10,000 sheets.

On the other hand, running copy operations were made using the apparatus configurated as shown in FIG. 11 and the apparatus configurated as shown in FIG. 13. In either apparatus, when vibration of 60 Hz was generated, an excellent image without any charging unevenness could be obtained up to 20,000 sheets, and in particular, in the apparatus of FIG. 13 which is equipped with vibration regulating member 34, less pollution of conductive fibers 5*a* was found in excess of 20,000 sheets.

By using means described heretofore, when a brush-type charging part composed of conductive fibers is employed as a charger, it is possible not only to prevent unevenness that occurs in the paper feed direction, but also to reduce the wear and tear of the brush tips and damage of the image bearing medium as well as to solve the problem that developer piled up in the brush tips brings about a pollution.

An embodiment of the fifth aspect and feature of the invention will hereinafter be described.

Figure 16:
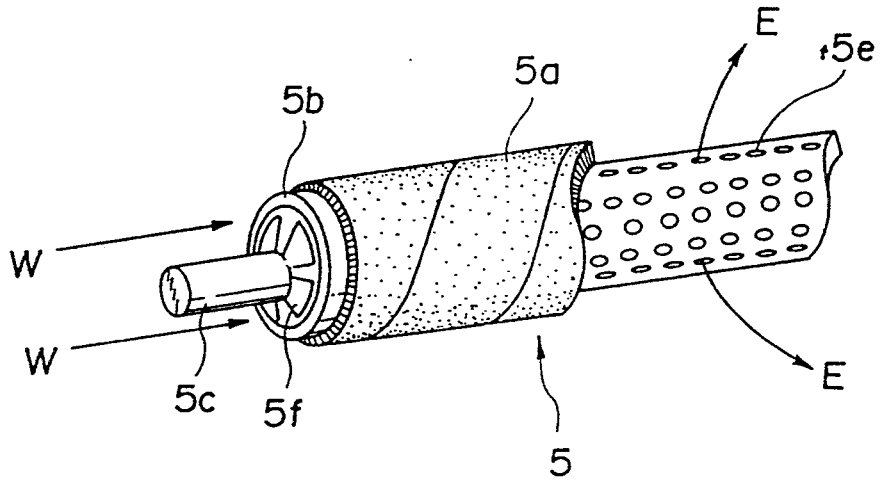
FIG. 16 is an oblique view with a partially cut-out portion showing an embodiment of a charging member having air-ventilation means.

FIG. 16 is an oblique view with partially cut-out portion showing an inner structure of a charging device 5 for used in an electrophotographic copier of the invention. In the figure, a reference numeral 5*a* designates a conductive fiber, which is adhered with, for example, an adhesive onto a surface of a cylindrical substrate 5*b* of charging device made of aluminum or other conductive material. The cylindrical substrate 5*b* is disposed at the ends thereof with opening portion 5*f* and made with a plurality of through-holes 5*e* on the side surface thereof. These opening and through-holes are disposed so as to introduce an air stream W of hot or cold air and eject air streams E through the fiber 5*a*. In the embodiment of the figure, there is shown an exemplary structure in which a shaft 5*c* of the charging device is attached on its base of the cylindrical substrate 5*b* and openings 5*f* are disposed on the base around the shaft. But this is a mere example, and another structure can of course be made, but is not shown particularly, in which a shaft 5*c* will be common with a cylindrical substrate 5*b* to flow an air stream directly thereinside.

With regard to the materials used to make such a charging device 5, a cloth of a synthetic fiber such as rayon, etc. onto which conductive granular material such as carbon powder is dispersed, can be used as the conductive fiber 5*a*.

An embodiment of the sixth aspect and feature of the invention will hereinafter be described.

Figure 17:
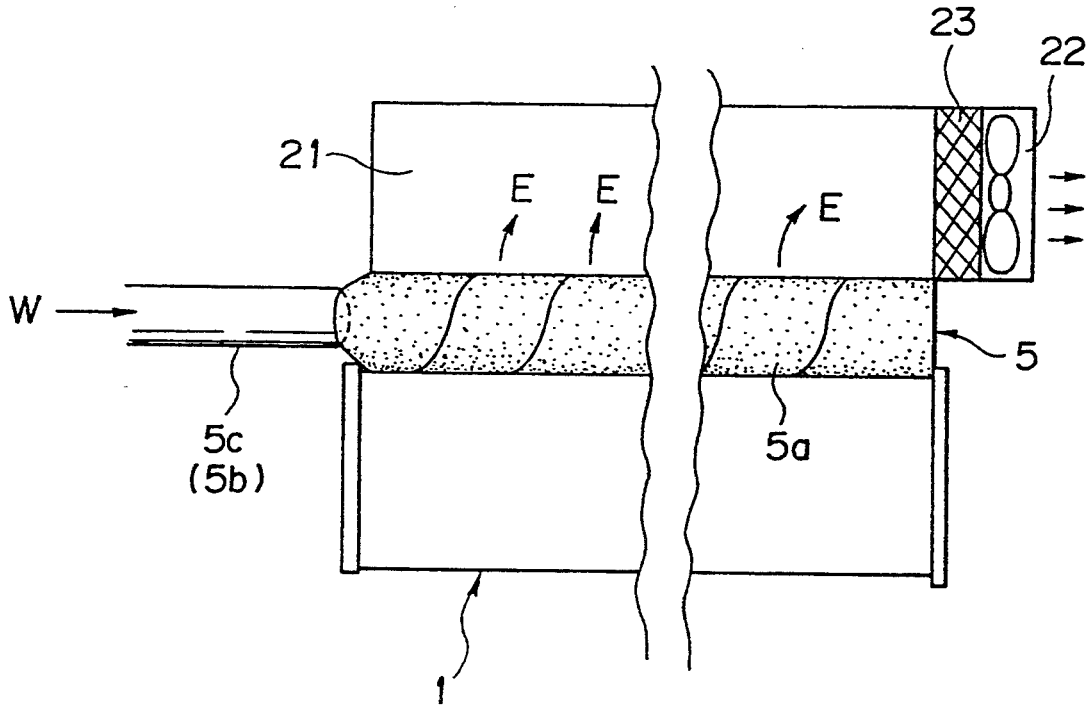
FIG. 17 is a front sectional view for conceptually illustrating another embodiment of a charging member having air-ventilation means.

FIG. 17 is a front view for conceptually illustrating a structure of the sixth feature of the invention. As is shown in the figure, a closed container 21 equipped with, for example, an exhausting means 22 such as a motor fan is disposed around a charging device, on a side thereof opposite to a photoconductor drum 1. The structure of charging device 5 is almost similar to that previously shown in FIG. 16. In this case, the shaft 5*c* is in common with a cylindrical substrate 5*b*, and an air stream W introduced from one end passing through through-holes (not shown), permeates conductive fibers 5*a* planted brush-wise. The thus permeated air flow E is forcibly drawn off by exhausting means 22.

A reference numeral 23 designates a filter, which is effective to catch the residual developer removed from conductive fiber 5*a*.

It should be noted that closed container 21 in the case may use any material as long as it has some strength and flexibility and as long as it is hard to damage the conductive fiber when it is brought into contact therewith. Such a material can be selected properly from, for example, well known, various kinds of industrial synthetic resin materials.

As has been discussed above, in the electrophotographic copier shown in the fifth or sixth embodiment, it is possible to provide an air duct, if necessary, between fixing unit 12 and the charging device in the previously shown schematic illustration of FIG. 7. With this arrangement, the hot air heated by heater 12*c* built in fixing unit 12, can be introduced and flowed as air stream W from openings 5*f* in FIG. 16 or from shaft 5*c* in FIG. 17 into the inside of substrate 5*b*.

Air stream W, passing through through-holes 5*e*, permeates conductive fiber 5*a* planted to be ejected outside as air flow E. In this while, if a closed container 21 is disposed around charging device 5, the air flow E that runs from the roots toward the tips of the planted fibers 5*a* is intensified by suction force of exhausting means 22. As a result, the residual developer sticking to tips of fibers can be blown away, and if a filter 23 is preferably disposed, the thus blown developer particles can be captured.

Moreover, when the hot air is used as the air stream W, the hot air can dry the fiber 5*a*, thus preventing the fiber 5*a* from being dampened and thereby from being worn out.

In this connection, the conductive fiber 5*a* used in the invention can employ, as stated previously, for example, a rayon cloth with carbon particles scattered thereon. But, generally, rayon fiber is known to have a high moisture absorptivity. For this reason, when rayon fiber or any other equivalent fiber is used for conductive fiber 5, a combination use of the dryer means as described above may be much more advantageous.

With the thus described arrangement, it is possible to prevent the occurrence of charging unevenness that would otherwise be caused by the contact of conductive fiber 5*a* having developer sticking thereto with the surface of the image bearing medium 1*a*. Further, it is possible to prevent the surface of the image bearing medium 5*a* from being damaged by the contact of the developer particles adhered to conductive fiber 5*a* with the image bearing medium 1*a*. Still, the removal of the developer sticking to the conductive fiber 5*a* improves the durability of the charging device 5 itself.

It should be noted that the present invention is not limited to the embodiments described above, but any change and modification can be made within a range of the invention.

An embodiment according to the seventh aspect and feature of the invention will hereinafter be described.

First, there will be made an explanation on reasons to limit planting intervals of conductive fibers and a ratio of peripheral velocity of a photoconductor drum to that of a roll-shaped body as a part of a charger device, to the aforementioned ranges.

Figure 18:
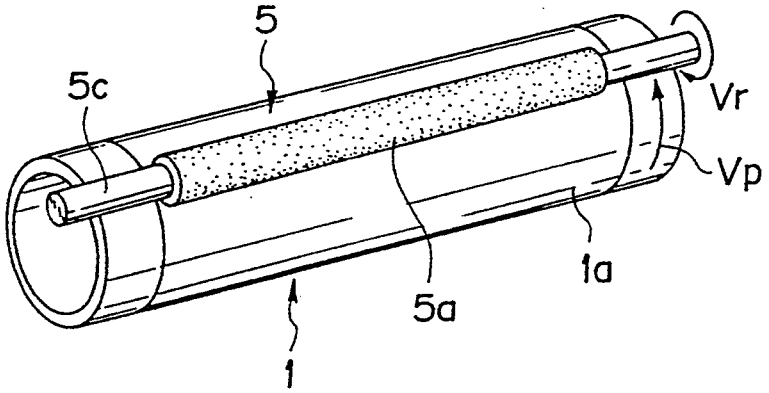
FIG. 18 is an oblique view for illustrating a relation between peripheral velocities of rotations of a photoconductive and a charging roller.

Now, consider a case in which a charging device 5 formed into a roll of conductive fiber 5*a* and a photoconductive drum 1 rotate at peripheral velocities of Vr and Vp, respectively, as obliquely shown in FIG. 18. In a state where roll-shaped charging device 5 and photoconductor drum 1 rotate, when tips of fibers 5*a* come up to the surface of the photoconductor while a voltage in excess of a discharge starting threshold that the Paschen' discharge characteristic teaches, is impressed to a clearance between the tips of fibers and photoconductor surface 1*a*, discharge starts to charge up photoconductor 1*a*. The discharge will stop when the charged voltage of photoconductor 1*a* increases and the potential difference across the clearance becomes smaller than the discharge starting threshold.

Figure 19:
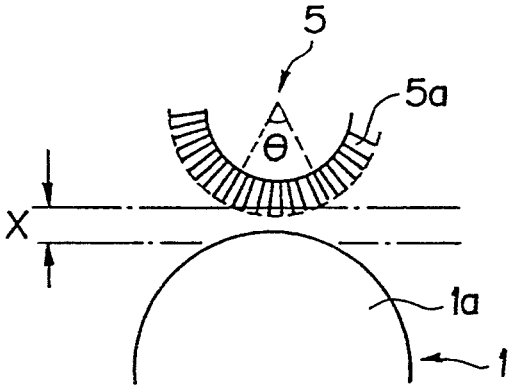
FIG. 19 is a schematic view showing an relation between a clearance between fiber ends of a charging roller and a surface of a photoconductor, and an angle within which discharging from the roller surface occurs.

The voltage applied across the clearance depends upon the voltage applied between charging device 5 and photoconductor drum 1, the distance of clearance and materials of fiber 5*a* and photoconductor 1*a*. Therefore, if materials of the photoconductor and the conductive fiber, and the voltage applied between fiber roller and the photoconductor are fixed, a state in which the potential difference across the clearance exceeds the aforementioned discharge starting threshold is limited to a condition in which the distance X between the tips of fibers 5*a* and the photoconductor surface 1*a* is within a certain range. In other words, the discharge is permitted to occur within only a certain range defined by an angle $\theta$ in roll-shaped charging device 5 (to be referred to as roller 5, hereinafter), as schematically shown in FIG. 19.

Now, consider an ideal case, in which a conductive roller 5 as a rotary shaft is planted with conductive fibers 5*a* uniformly and closely without any space, and impressed by a sufficient voltage higher than the discharge starting threshold. In this case, an entire part of photoconductor surface 1*a* can necessarily face the tips of conductive fibers 5*a* within a distance in which the potential difference exceeds the discharge starting threshold. As a result, the photoconductor surface 1*a* would be charged uniformly.

Figure 20:
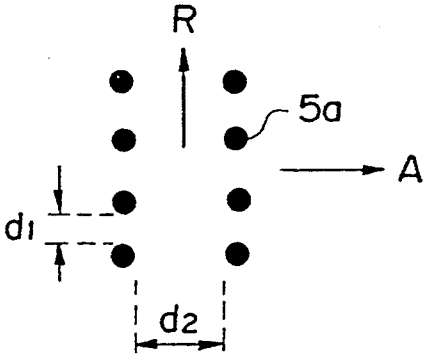
FIG. 20 is a schematic view showing a state of planted conductive fibers.

On the contrary, consider another case, in which no fiber 5*a* is planted in a region enclosed by a side d1 in a rotational direction R of roller 5 and another side d2 in an axial direction A, as shown in FIG. 20. Here, for simplicity, it is assumed that the discharge occurs when the clearance distance X takes a certain value, or the angle $\theta$ within which discharge is permissible becomes unlimitedly close to zero.

Now, the peripheral velocities of rotations of roller 5 and photoconductor drum 1 will be respectively represented by Vr and Vp, as mentioned above. At this time, a region that is defined by dimension $d1 \times d2 \times (Vp/Vr)$ on photoconductor drum 1 is to face the region enclosed by $d1 \times d2$ when both the regions are located in a space in which discharge is allowable. Accordingly, the region on the drum cannot encounter any conductive fibers 5*a*, or does not face the tips of fibers in a space within which the potential difference exceeds the discharge starting threshold, and therefore no charge is stored to the region. In the real state, since the discharge is permissible in a range of an angle $\theta$ that is decided depending upon the applied voltage between fiber roller 5 and photoconductor drum 1, the distance of clearance, the materials of fibers 5*a* and photoconductor 1*a*, it cannot be said that no part of the region $d1 \times d2 \times (Vp/Vr)$ is discharged at all, but at least, failure of charging tends to occur across the region.

Of course, no failure in a final image of copy is observed if the dimension of the region $d1 \times d2 \times (Vp/Vr)$ is enough smaller than the average particle size of the developer or toner, etc. used in the electrophotographic copier to which the charging device 5 is incorporated. But, when the dimension of the region $d1 \times d2 \times (Vp/Vr)$ is larger, the defects will appear on the final image of copy. Here, the size of developer is defined as to be an area projected on a plane of the developer particle.

Under consideration of what has been discussed above, in the invention, the planting intervals of fibers on the roller 5 and the ratio of the peripheral velocities of rotation are to be limited such that the value $d1 \times d2 \times (Vp/Vr)$ (more specifically, a product of the planting intervals d1 and d2 of conductive fibers 5*a* in the rotational direction of roller 5 and in the axial direction and the ratio (Vp/Vr), or the ratio of peripheral velocity of rotation of photoconductor drum 1 to that of roller 5) may be smaller than the average particle size of the developer used in the electrophotographic system.

For example, the average particle size of the developers generally used at present is about 10 $\mu$m. Therefore, by controlling the value $d1 \times d2 \times (Vp/Vr)$ to be less than approximately $10 \times 10\ \mu m^2$, it is possible to prevent image defects that would be caused by charging fault.

An embodiment of the charging device 5 that may be used for the invention, is prepared by swathing a cloth planted with conductive fibers 5*a* in which the resistance is controlled by adjusting the amount of dispersed carbon particles, around a conductive shaft 5*c* of, for example, 6 mm in diameter using a conductive adhesive to form a roll-shaped body trimmed so as to have an outer diameter of 12 mm.

In order to confirm the effect of the invention, the following experiment was carried out.

An electrophotographic copier having configurations shown in FIG. 7 was used. A developer having an average particle size of 8 to 10 $\mu$m was used.

In the electrophotographic copier, a roller 5 with a conductive fiber where values d1 and d2 (in FIG. 20) are fixed equal to 8 $\mu$m, is used, while velocity Vp is fixed at 53 mm/sec. In this condition, occurrence of image defect was studied by changing value Vr.

At the beginning, an image was formed with Vr being fixed at 265 mm/sec., which was five times as fast as Vp. The thus formed image was completely free from defect, having an excellent contrast. This indicates that charging onto the photoconductor was uniform and dense.

Next, with Vr being fixed at the same value, i.e, 53 mm/sec., image defect could be inhibited to a negligible level. But, the contrast was slightly low-graded. Meanwhile, in practice, image defects caused by unevenness of rotational speed and other factors, might occur with a high possibility, therefore, Vr is preferably set large, or the value $d1 \times d2 \times (Vp/Vr)$ should be enough small as before, compared to the size of a developer used (60 to 100 $\mu m^2$).

When Vr was set up at 26.5 mm/sec., half the velocity Vp, unevenness of image density that could be attributed to the unevenness of charging, occurred over the whole image.

As is apparent from the result, the present invention is more excellent than the conventional means.

Thus, in accordance with the invention, by properly limiting the condition of plating fibers and the relational ratio between the peripheral velocities of the charger device and photoconductor drum, it is possible to provide an electrophotographic copier which is able to offer a final image with high quality, free from defects due to charging unevenness.

An embodiment according to the eighth aspect and feature of the invention will hereinafter be described.

Figure 21:
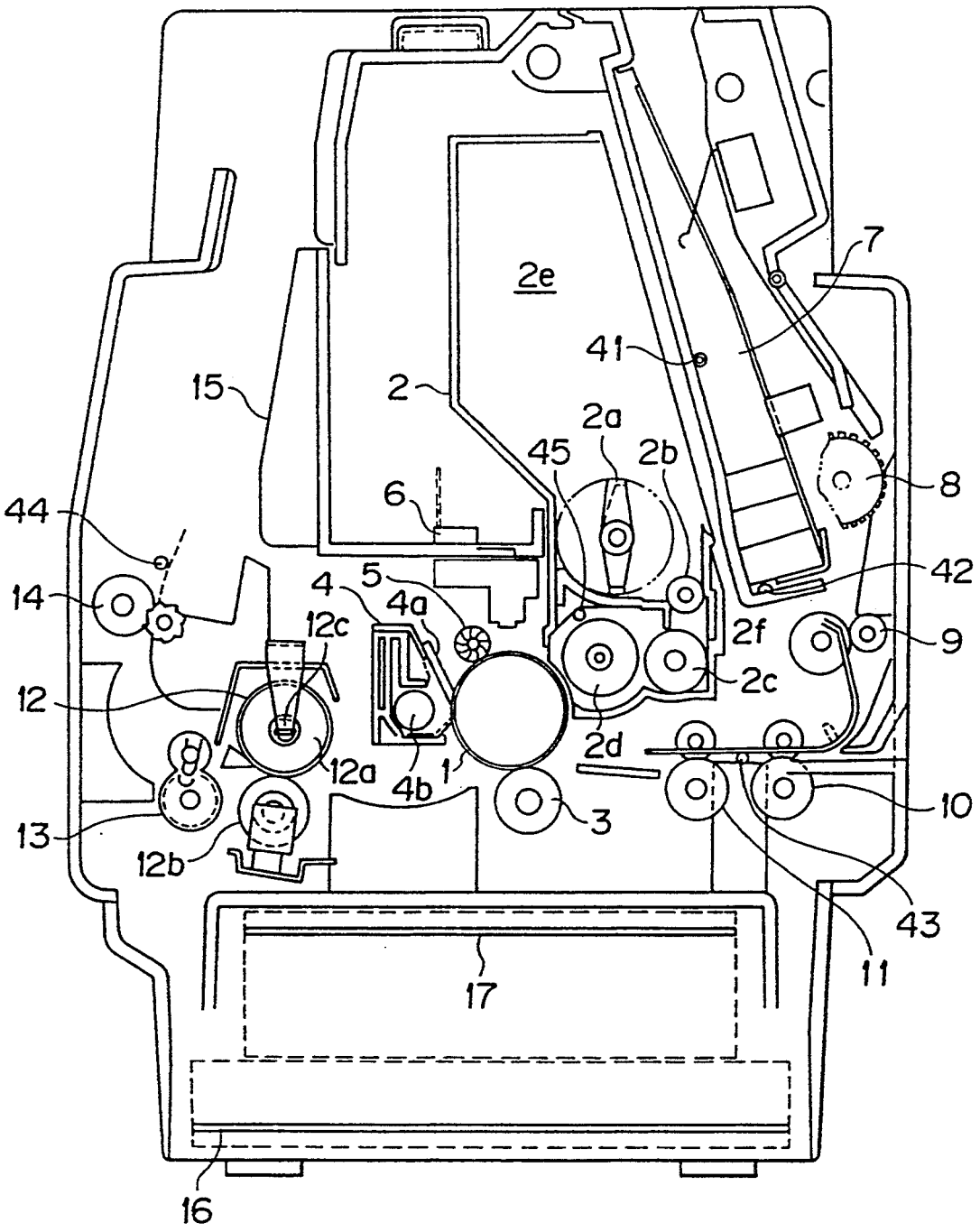
FIG. 21 is a schematic illustration showing locations of sensors disposed in various portions in the electrophotographic copier of the embodiment shown in FIG. 7.

FIG. 21 is a schematic illustrative view showing an example of configurations of an electrophotographic copier in which the embodiment is applied. The basic arrangement of the copier is similar to that shown in FIG. 7, but in the configurations of FIG. 21, there are provided various sensors that are required to realize the subject embodiment. More specifically, as shown in FIG. 21, in order to detect copy sheets, there are disposed a paper end detecting sensor 41 at the bottom of a cassette 7, and a paper detecting sensor 2 in the vicinity of the conveyer roller 9 for paper feed, while disposed between conveyer roller 10 and resist roller 11 is a paper feed detecting sensor 43 for detecting entrance of a sheet from cassette 7 to transfer side. Paper exit detecting sensor 44 for detecting paper discharge is disposed downstream of a paper discharging roller 14. In addition, there is provided a developing unit-presence detecting sensor 45 for detecting the presence of a developing unit.

Figure 23:
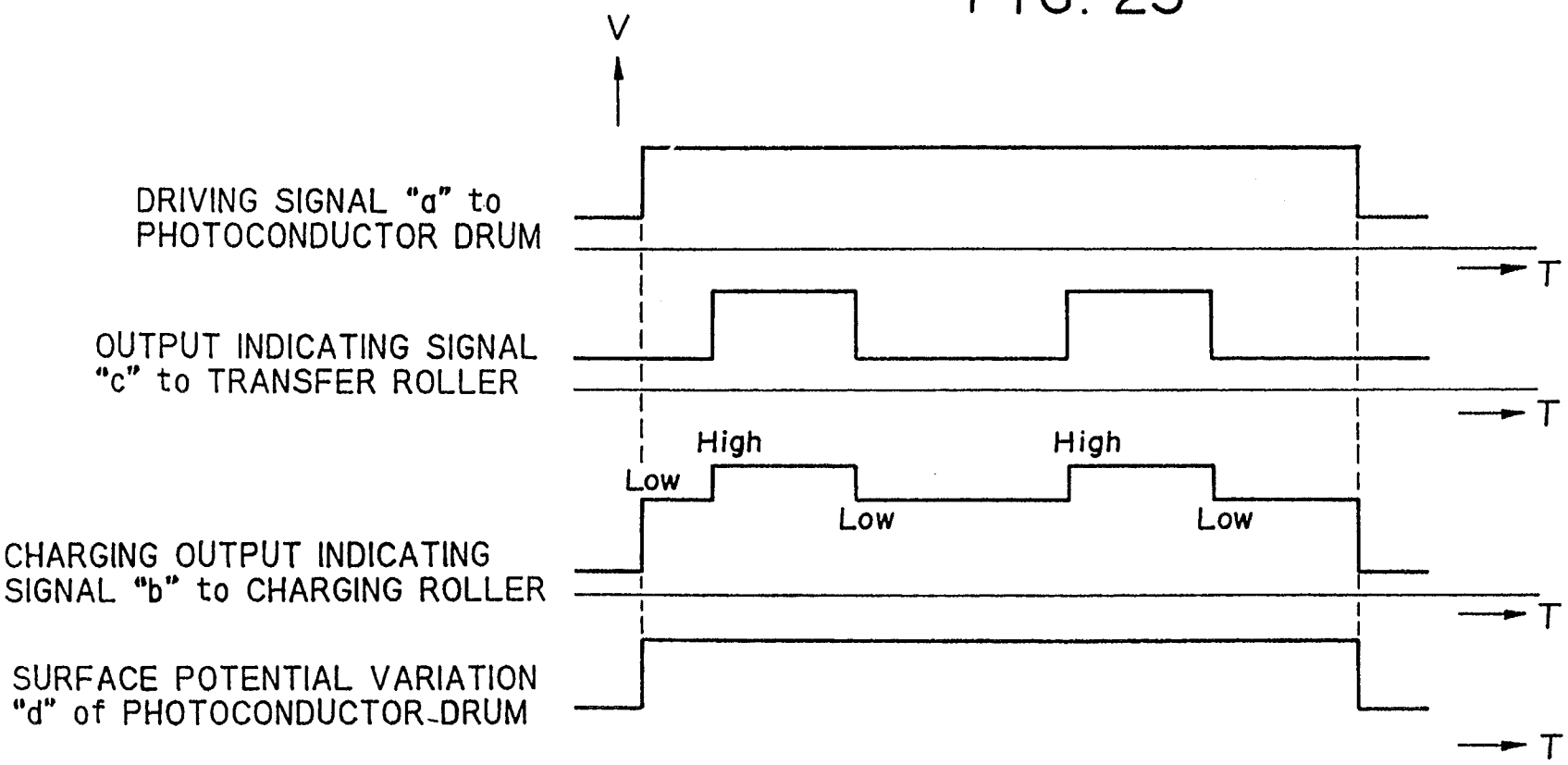
FIG. 23 is a characteristic chart showing time(T)-voltage(V) relations of waveforms of various signals (a driving signal to a photoconductor drum, an output indicating signal to a transfer roller, a charging voltage output indicating signal to a charging roller) and variation of surface potential of a photoconductor drum after a transfer operation in the apparatus shown in FIG. 21, in accordance with a method of the invention.

In this arrangement, a recording sheet stored on paper feed cassette 7 is drawn from the lower end of the paper cassette by the rotation of paper feed roller 9 which is driven by the power supplied from a power source, triggered by a transfer energizing signal transmitted from a controller 16 after the start of rotation of photoconductor drum 1 activated by a driving signal (refer to FIG. 23). Then, the thus fed sheet is conveyed by conveyer roller 10 and resist roller 11 to the nip formed between photoconductor drum 1 and transfer roller 3.

Figure 22:
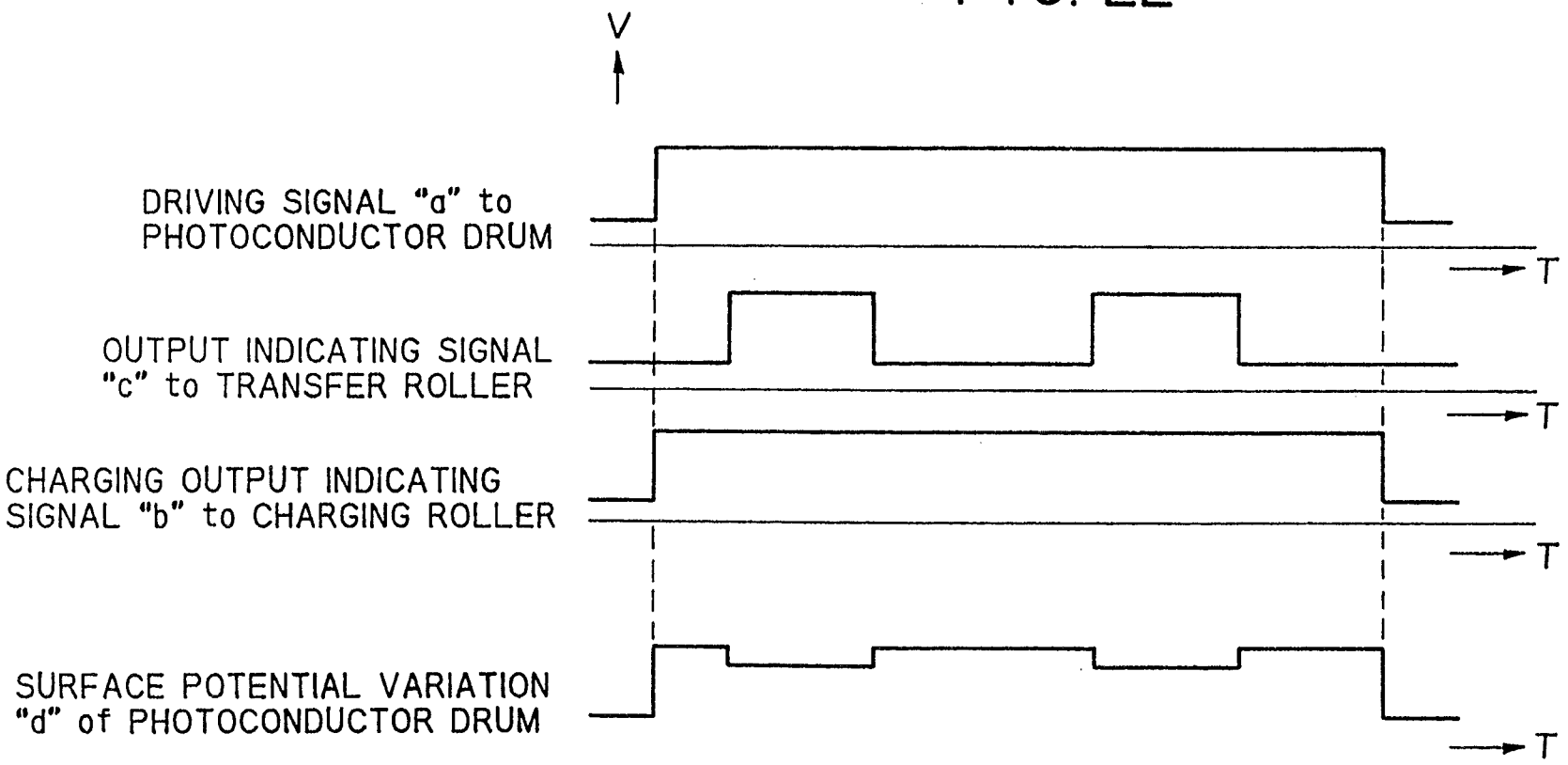
FIG. 22 is a characteristic chart showing time(T)-voltage(V) relations of waveforms of various signals (a driving signal to a photoconductor drum, an output indicating signal to a transfer roller, a charging voltage output indicating signal to a charging roller) and variation of surface potential of a photoconductor drum after transfer operation in the apparatus shown in FIG. 21, in accordance with a prior art method.

Operation of the electrophotographic copier in accordance with the conventional driving manner, used to be effected such that, as shown in FIG. 22, when photoconductor drum 1 is activated to drive by a driving signal "a", a charging output indicating signal "b" simultaneously activates charging roller 5, so that the charger impresses the surface of photoconductor drum 1 at a certain charging voltage in accordance with the signal "b" in FIG. 22 (in which signals are expressed depending upon time T). Then, after a certain span of time, in accordance with an output indicating signal "c" to transfer roller shown in FIG. 22, a predetermined voltage for transfer is impressed to transfer roller 3, so that toner powder image on photoconductor drum 1 is transferred onto recording sheet 5 sent out by conveyer roller 10 and resist roller 11. As a result, the surface potential of photoconductor drum 1 after transfer is completed exhibits variation depending on time T as indicated by surface potential variation plot "d" in FIG. 22.

In accordance with the present invention, as shown in a waveform of charging output indicating signal to charging roller in FIG. 23, since a portion on the photoconductor corresponding to region subjected to the transfer voltage, is impressed by the charging roller with a charging application voltage higher than that applied to the region without the transfer voltage applied, the surface potential after completion of transfer operation of photoconductor drum 1 as an image bearing medium can be compensated. As a result, a uniform surface potential can be obtained as shown by the variation of the surface potential shown in FIG. 23.

As an experiment to confirm the effect of the invention, the surface potential of photoconductor drum 1 was measured using the electrophotographic copier shown in FIG. 21. Upon the measurement of the surface potential of the photoconductor, a conductive roller mainly consisting of silicon rubber (resistance: $3.0\times10^6$ Ω, hardness JIS-A: 36 degrees, roller size: 11 mm) was used as charging roller 5. When applied voltage to the charging roller was fixed at a constant value (for example, at −1180 V) in accordance with the conventional process shown in FIG. 22, the resulting surface potential of the photoconductor was charged at about −600 V. The measurement of the surface potential of the photoconductor drum was carried out with respect to both the regions to which transfer operation had been effected and to which no transfer operation was effected. In the conventional process, the measurement of surface potential for the region with the transfer operation effected was −560 V, whereas the measurement of surface potential for the region with no transfer operation effected was −585 V. That is, the variation of surface potential was Δ25 V as shown in Table 1.

TABLE 1

| Potential in Region with Transfer | Potential in Region without Transfer | Potential Variation |
|---|---|---|
| −560 V | −585 V | Δ25 V |

As the same charging roller 5 (refer to FIG. 21) is used, the surface potential of photoconductor drum 1 was measured by applying charging voltage in accordance with the present invention. That is, the voltage that was applied to charging roller 5 was adapted to change over between two levels. As shown in Table 2, the region on the photoconductor surface corresponding to the region without transfer was impressed by −1180 V as used to be.

TABLE 2

| Applied Voltage Region without Transfer | Applied Voltage Region with Transfer |
|---|---|
| −1180 V (LOW) | −1205 V (HIGH) |

The region on the photoconductor surface corresponding to the region with transfer was impressed by −1205 V. The surface potential of the photoconductor was measured by switching the two levels of charging voltage in accordance with this method of charging. The measurement of surface potential for the region with the transfer operation effected was −585 V, whereas the measurement of surface potential for the region with no transfer operation effected was −585 V. That is, the variation of surface potential was Δ0 V as shown in Table 3.

TABLE 3

| Potential in Region with Transfer | Potential in Region without Transfer | Potential Variation |
|---|---|---|
| −585 V | −585 V | Δ0 V |

As in the invention, when the photoconductor was charged by the charging roller having two levels of charging voltage, the resulting surface potential presented uniformity over the photoconductor surface as shown above, and upon printing, a sharp image with less fog was obtained by uniformalizing the surface potential over the photoconductor surface.

As another experiment to establish the effect of the invention more completely, the surface potential of photoconductor drum 1 was measured using the electrophotographic copier shown in 21. Upon the measurement of the surface potential of the photoconductor, a conductive roller mainly consisting of urethane rubber (resistance: $1.2\times10^5$ Ω, hardness JIS-A: 35 degrees, roller size: 11 mm) was used as charging member. When applied voltage to the charging roller was fixed at a constant value (for example, at −1140 V) in accordance with the conventional process, the resulting surface potential of the photoconductor was charged at about −600 V. The measurement of the surface potential of the photoconductor drum was carried out with respect to both the regions to which transfer operation had been effected and to which no transfer operation was effected. In the conventional process, the measurement of surface potential for the region with the transfer operation effected was −555 V, whereas the measurement of surface potential for the region with no transfer operation effected was −580 V. That is, the variation of surface potential was Δ25 V. Therefore, the voltage that was applied to charging roller 5 was adapted to change over between two levels. That is, the region on the photoconductor surface corresponding to the region without transfer was impressed by −1140 V as used to be. On the other hand, the region on the photoconductor surface corresponding to the region with transfer was impressed by −1165 V. The surface potential of the photoconductor was measured by switching the two levels of charging voltage in accordance with this method of charging. The measurement of surface potential for the region with the transfer operation effected was −580 V, whereas the measurement of surface potential for the region with no transfer operation effected was −580 V. That is, the variation Of surface potential was Δ0 V. As in the invention, when the photoconductor was charged by the charging roller having two levels of charging voltage, the resulting surface potential presented uniformity over the photoconductor surface as shown above, and upon printing, a sharp image with less fog was obtained by unifying the surface potential over the photoconductor surface.

Although description of this embodiment was made on the example in which a conductive roller-type transfer unit (or transfer roller) was used as its transfer unit 3, the charging voltage applying means should not be limited to such transfer rollers, but the invention can be applied to general electrophotographic copiers using a corona discharge type transfer unit.

As described above, in the conventional charging voltage application method, the surface potential of the photoconductor is influenced or caused to be different by the transfer operation. That is, the difference of surface potential is generated between whether the transfer voltage is applied to the image bearing medium or not.

More specifically, in the reverse-developing process, taking the charged surface potential to be positive, the surface potential of a region that are is subjected to the transfer voltage will be lowered since the polarity of the transfer voltage is opposite to that of the charging voltage.

To deal with this, in accordance with the method of the invention for applying charging voltage to the image bearing medium, the voltage applied to the charging roller is increased by an increment corresponding to reduction of the surface potential caused by the transfer voltage, in order to unify the surface potential after the charging. By this method, the portion of photoconductor having its surface potential lowered by the transfer can be supplied with more charges, so that the lowered surface potential is compensated to be uniform. As a result, it is possible to provide an image with sharpness and less fog.

Finally, an embodiment according to the ninth aspect and feature of the invention will hereinafter be described.

Figure 24A:
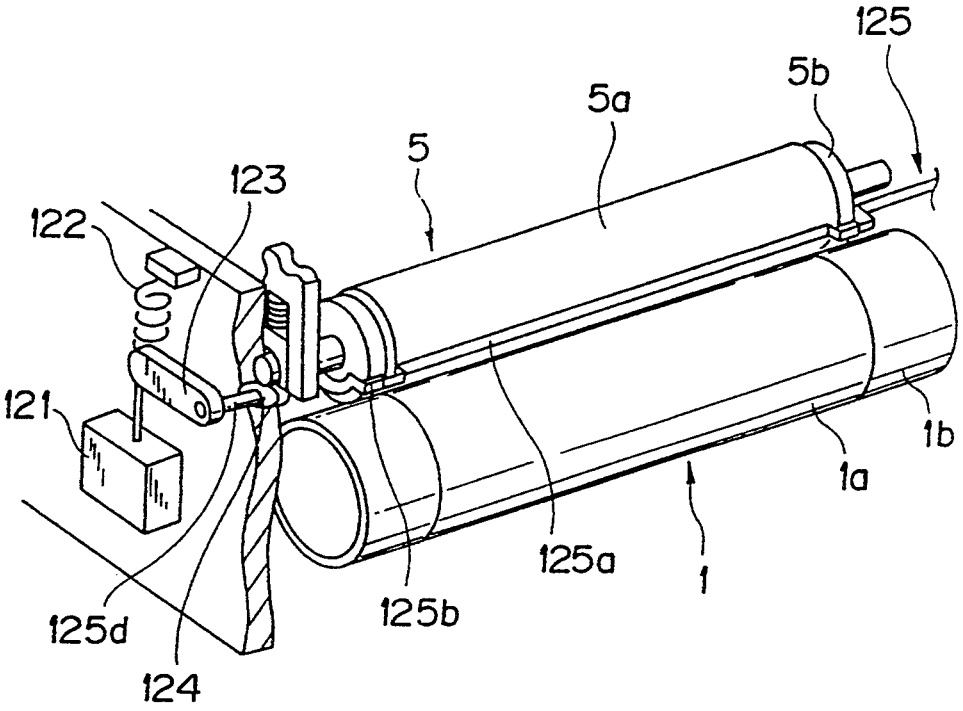
FIG. 24A is an oblique view showing an operative state in an embodiment of a charging device according to the invention.
Figure 24B:
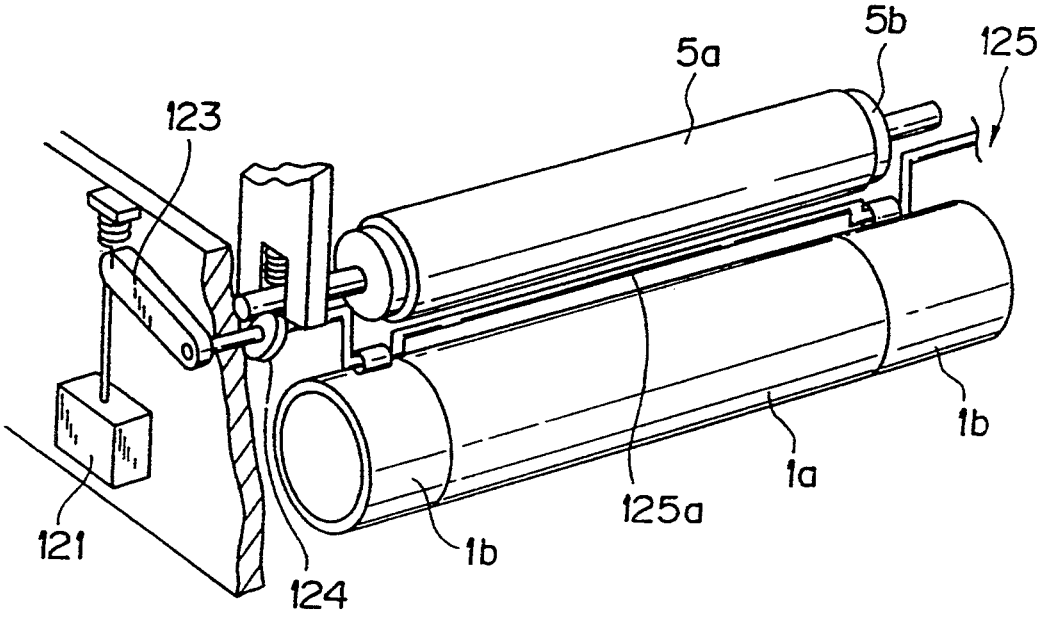
FIG. 24B is an oblique view showing an inoperative state in the embodiment of a charging device according to the invention.
Figure 25:
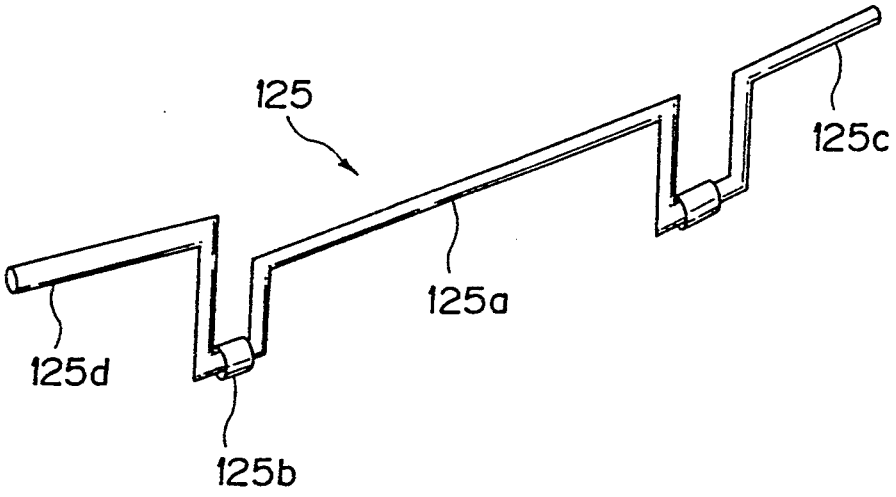
FIG. 25 is an oblique view showing an embodiment of a dirt preventing member used in a charging device of the invention.

FIGS. 24A and 24B are oblique views showing elemental components of a charging device according to an embodiment of the invention. Particularly, FIG. 24A shows an operative state of an image forming device, whereas FIG. 24B shows a inoperative state of the same image forming device. FIG. 25 is an oblique view showing a dirt preventing member as a main constituent of the invention. As shown in FIGS. 24A and 24B, the charging device comprises mainly a charging roller 5 and a dirt preventing member 125.

Specifically, the charging roller 5 comprises a conductive substrate 5*b* and a conductive fiber portion 5*a* which is made from a brush or a cloth of conducive fibers or fiber, and covers and is disposed on the substrate 5*b*. The dirt preventing member 125 comprises, as shown in FIGS. 24A, 24B and 25, fixing shafts 125*c* and 125*d*, a pair of supporting portions 125*b* each connected to respective shafts 125*c* and 125*d* and a cleaning porion 125*a* between the supporting portions 125*b*, all integrated. Thus composed member 125 is disposed aligned with the longitudinal axes of the charging roller 5 and a photoconductor 1. Besides, there are provided a solenoid 121, a spring 122, a bar 123, an elliptic roller 124 as components for functioning charging roller 5 and dirt preventing member 25. The photoconductor drum 1 comprises an aluminum drum and a photoconductive layer. The photoconductive layer that forms a charge-receptive portion 1*a* is disposed on the center portion with respect to an axial direction of the drum, whereas the aluminum drum substrate is exposed on the both ends in the axial direction, forming non-charge-receptive portions 1*b*.

In an operation mode of the charging device, solenoid 121 is activated, as shown in FIG. 24A, and pulls down bar 123 opposing the force exerted by spring 122, whereby elliptic roller 124 is rotated to such a position that the roller 124 supports charging roller 5 in a direction of its minor axis. The pulling down of the bar further causes a rotation of a dirt preventing member 125 that is connected through the elliptic roller 124 with bar the 123.

The rotation of the dirt preventing member 125 causes supporting portions 125*b* of dirt preventing member 125 to be disengaged from non-charge-receptive portions 1*b*, or the aluminum drum, so that charging roller 5 moves downward as shown in FIG. 24A. As a result, the conductive fiber portion 5*a* on the surface of charging roller 5 is brought in contact with photoconductive layer 1*a* of photoconductor 1, while the cleaning portion 125*a* of the dirt preventing member relatively pats and dusts away the conductive fiber portion 5*a* that rotates together with photoconductor 1.

At the inoperative mode of the charging device, solenoid 121 is unactuated as shown in FIG. 24B, therefore, spring 122 pulls up bar 123, whereby elliptic roller 124 is rotated to such a position that the roller 124 supports charging roller 5 in a direction of its major axis. The pulling up of the bar further causes a rotation of dirt preventing member 125, which in turn causes supporting portions 125*b* to contact with the non-charge-receptive portions 1*b*, or the aluminum drum, so that charging roller 5 moves upward, separating the charging roller 5 from the photoconductor 1.

Thus, in the invention, when the charging device is in operation, the residual toner or foreign substances adhered to the conductive fiber on the charging roller surface are slapped and dusted away by means of the dirt preventing member. As a result, it is possible to prevent the occurrence of charging unevenness and damage to the photoconductor surface that would be caused when the conventional conductive fiber with residual toner adhered is brought in contact with the image bearing surface of the photoconductor. Free from such deterioration, the present invention can provide an excellent image.

Furthermore, when the charging device is out of operation, the conductive fiber is shifted into a standing position so as to be spaced from the photoconductor. By this measure, wear-out of the fiber can be prevented. Consequently, the occurrence of charging unevenness attributed to the wear-out of fiber can be prevented as well as improving the durability of the fiber and device. Besides these, the present invention can excellently provide a secure charging device at a low cost.

What is claimed is:

1. An electrophotographic copier, equipped with a conductive roller or a conductive brush as a charging device of a contact type for effecting an electrophotographic copying process, characterized in that said charging device comprises: an aggregation of conductive fiber formed like a brush; vibrating means to vibrate said aggregation of conductive fiber; and a comb-like vibration regulating member held across an entire part of said aggregation of conductive fiber, and when an image bearing medium is to be charged by bringing said brush-like charging member into contact therewith, said aggregation of conductive fiber is vibrated by said vibrating means while regulated by said comb-like vibration regulating member, in a state in which said aggregation of conductive fiber is kept in contact with said image bearing medium.

2. An electrophotographic copier, equipped with a conductive roller or a conductive brush as a charging device of a contact type for effecting an electrophotographic copying process, characterized in that said charging device comprises: an aggregation of conductive fiber formed like a brush; vibrating means to vibrate said aggregation of conductive fiber; and a comb-like vibration regulating member held through across an entire part of said aggregation of conductive fiber, and when an image bearing medium is to be charged by bringing said brush-like charging member into contact therewith, said aggregation of conductive fiber is vibrated by said vibrating means while regulated by said comb-like vibration regulating member, in a state in which said aggregation of conductive fiber is kept in contact with said image bearing medium, wherein said charging member is vibrated in a direction substantially perpendicular to the rotational direction of said image bearing medium.

3. An electrophotographic copier, equipped with a conductive roller or a conductive brush as a charging device of a contact type for effecting an electrophotographic copying process, wherein an image bearing medium is charged by bringing a charging device into contact therewith, and a developer of the same polarity with the charging potential of said image bearing medium is used, said charging device comprising: a conductive, cylindrical substrate having on its surface a plurality of through-holes through which cold or hot air can be passed; and conductive fiber formed like a brush and planted conductively on the surface of said substrate.

4. An electrophotographic copier, equipped with a conductive roller or a conductive brush as a charging device of a contact type for effecting an electrophotographic copying process, wherein an image bearing medium is charged by bringing a charging device into contact therewith, and a developer of the same polarity with the charging potential of said image bearing medium is used, being characterized in that, said charging device comprising: a conductive, cylindrical substrate having on its surface a plurality of through-holes through which cold or hot air can be passed; and conductive fiber formed like a brush and planted conductively on the surface of said substrate, and said electrophotographic copier further comprising a closed container having an air-exhausting means and enclosing said charging device.

5. An electrophotographic copier according to claim 4, wherein said air-exhausting means comprises a filter.

6. An electrophotographic copier, equipped with a conductive roller or a conductive brush as a charging device of a contact type for effecting an electrophotographic copying process, wherein an image bearing medium is charged by bringing a charging device into contact therewith, and a developer of the same polarity with the charging potential of said image bearing medium is used, being characterized in that, said charging device comprising: a conductive, cylindrical substrate having on its surface a plurality of through-holes through which cold or hot air can be passed; and conductive fiber formed like a brush and planted conductively on the surface of said substrate, wherein an air stream is introduced from a heating means of a fixing unit of said electrophotographic copier, and said electrophotographic copier further comprising a closed container having an air-exhausting means and enclosing said charging device.

7. An electrophotographic copier, equipped with a conductive roller or a conductive brush as a charging device of a contact type for effecting an electrophotographic copying process, comprising a photoconductor drum and a charging device of a roll-shaped body with conductive fiber or an aggregation thereof planted thereon, wherein a photoconductive layer on said photoconductor drum is charged by bringing said charging device into contact therewith while said photoconductor drum and said roll-shaped body are individually rotated with a voltage impressed therebetween, being characterized in that planting intervals between fibers and a ratio of a peripheral velocity of rotation of said photoconductor to that of said roll-shaped are limited so that, a product, $d1 \times d2 \times (Vp/Vr)$ is smaller than the average size of developer particles used in the electrophotographic process, where d1 is a planting interval between fibers in the rotational direction of said roll-shaped body with said conductive fiber of an aggregation planted thereon; d2 is an interval between fibers in the axial direction of said roll-shaped body; Vr and Vp are peripheral velocities of rotation, respectively, of said roll-shaped body forming said charging device and said photoconductor drum, and therefore, (Vp/Vr) indicates a ratio of peripheral velocity of rotation.

8. An electrophotographic copier, equipped with a conductive roller or a conductive brush as a charging device of a contact type for effecting an electrophotographic copying process, said charging device comprising conductive roll-shaped charging means, through which charging voltage is applied to an image bearing medium, being characterized in that said charging voltage is changed over between two levels so that, when an image is formed, different voltages of charging can be applied to a region with transfer voltage having been applied thereto and a region without transfer voltage applied thereto, respectively.

9. An electrophotographic copier, equipped with a conductive roller or a conductive brush as a charging device of a contact type for effecting an electrophotographic copying process, comprising:

a charging roller having conductive fiber covered on a surface thereof;

a dirt preventing member disposed in alignment with a longitudinal direction of said charging roller so as to be shifted between a uniformly contacting position with said charging roller and a spaced position therefrom; and means for bringing said dirt preventing member into uniform contact with the conductive fiber on the charging roller surface when said charging device is in operation and in contact with a photoconductor so as to clean the surface of the conductive fiber on said charging roller, and for retracting the dirt preventing member from the charging roller when said charging device is out of operation.

* * * * *